US009950533B2

(12) United States Patent
Ohnishi

(10) Patent No.: US 9,950,533 B2
(45) Date of Patent: Apr. 24, 2018

(54) HEAD CLEANING APPARATUS, INKJET PRINTER AND HEAD CLEANING METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/128,415

(22) PCT Filed: Mar. 24, 2015

(86) PCT No.: PCT/JP2015/058837
§ 371 (c)(1),
(2) Date: Sep. 22, 2016

(87) PCT Pub. No.: WO2015/146951
PCT Pub. Date: Oct. 1, 2015

(65) Prior Publication Data

US 2017/0100937 A1 Apr. 13, 2017

(30) Foreign Application Priority Data

Mar. 25, 2014 (JP) ..... 2014-062812

(51) Int. Cl.
*B41J 2/165* (2006.01)

(52) U.S. Cl.
CPC ..... *B41J 2/16541* (2013.01); *B41J 2/16547* (2013.01); *B41J 2/16552* (2013.01)

(58) Field of Classification Search
CPC ..... B41J 2/16552; B41J 2/16547; B41J 2/16555; B41J 2002/16558; B41J 2002/16573; B41J 2/16541; B41J 2/16582
See application file for complete search history.

(56) References Cited

U.S. PATENT DOCUMENTS

2006/0274110 A1* 12/2006 Kang ..... B41J 2/16552 347/33
2007/0195122 A1* 8/2007 Hiruma ..... B41J 2/16511 347/29

(Continued)

FOREIGN PATENT DOCUMENTS

JP 2002019132 * 1/2002 ..... B41J 2/165
JP 2005225203 8/2005

(Continued)

OTHER PUBLICATIONS

"Internationalsearch Report (Form PCT/ISA/210)", dated Jun. 9, 2015, with English translation thereof, pp. 1-4.

(Continued)

*Primary Examiner* — Henok Legesse
(74) *Attorney, Agent, or Firm* — JCIPRNET

(57) ABSTRACT

Provided are a head cleaning apparatus, an inkjet printer, and a head cleaning method that allow an ink discharging surface of an inkjet head to be more adequately cleaned than the known art.

A head cleaning apparatus has a cleaning liquid reserving tank containing a cleaning liquid for cleaning an ink discharging surface of an inkjet head from which an ink is discharged. The head cleaning apparatus further has a removing unit that removes dirt and/or ink stain from the ink discharging surface while the ink discharging surface is being immersed in the cleaning liquid in the cleaning liquid reserving tank, and a wiper that wipes off the cleaning liquid left on the ink discharging surface after the removal of dirt and/or ink stain by the removing unit. The removing unit and the wiper are both disposed in the cleaning liquid reserving tank.

15 Claims, 15 Drawing Sheets

(56) References Cited

U.S. PATENT DOCUMENTS

| | | | | |
|---|---|---|---|---|
| 2008/0158291 | A1* | 7/2008 | Satake | B41J 2/16535 347/33 |
| 2012/0026254 | A1* | 2/2012 | Tamaki | B41J 2/17509 347/85 |
| 2016/0152033 | A1* | 6/2016 | Wakabayashi | B41J 2/16552 347/28 |

FOREIGN PATENT DOCUMENTS

| | | |
|---|---|---|
| JP | 2008073638 | 4/2008 |
| JP | 2009196293 | 9/2009 |
| JP | 2013052507 | 3/2013 |
| JP | 2013184453 | 9/2013 |

OTHER PUBLICATIONS

"Office Action of Japan Counterpart Application," with English translation thereof, dated Jul. 12, 2017, p. 1-p. 10.

* cited by examiner

HEAD CLEANING APPARATUS, INKJET PRINTER AND HEAD CLEANING METHOD

CROSS-REFERENCE TO RELATED APPLICATION

This application is a 371 application of International PCT application serial no. PCT/JP2015/058837, filed on Mar. 24, 2015, which claims the priority benefit of Japan application no. 2014-062812, filed on Mar. 25, 2014. The entirety of each of the above-mentioned patent applications is hereby incorporated by reference herein and made a part of this specification.

TECHNICAL FIELD

This invention relates to a head cleaning apparatus for use in cleaning an ink discharging surface of an inkjet head, an inkjet printer, and a head cleaning method.

BACKGROUND ART

Inkjet heads have an ink discharging surface from which inks are discharged. Some of the known head cleaning apparatuses devised to clean the inkjet head are equipped with a cleaning liquid feeder, a removing member, and a wiping member. The cleaning liquid feeder feeds the ink discharging surface with a cleaning liquid. After the cleaning liquid is applied to the ink discharging surface by the cleaning liquid feeder, the removing member rubs off the cleaning liquid between the head modules of the inkjet head. The wiping member wipes the ink discharging surface after the cleaning liquid between the head modules is rubbed off by the removing member (for example, Patent Literature 1).

CITATION LIST

Patent Literature 1: Japanese Unexamined Patent Publication No. 2013-52507

SUMMARY OF INVENTION

Technical Problems

Thus, the known head cleaning apparatus feeds the ink discharging surface of the inkjet head with only a small amount of cleaning liquid, and then wipes off the cleaning liquid using the removing member and the wiping member. Such an apparatus, however, poses a concern that the ink discharging surface may not be thoroughly cleaned.

For example, while the head cleaning apparatus is wiping off the cleaning liquid on the ink discharging surface, dirt and/or ink stain once removed from the ink discharging surface by the cleaning liquid may possibly be accidentally pushed into the ink discharge ports by the removing member and/or wiping member. In such an event, dirt and/or ink stain lodged in the ink discharge ports are likely to block the ports, incurring poor discharge performance.

Accordingly, this invention is directed to providing a head cleaning apparatus, an inkjet printer, and a head cleaning method that may allow an ink discharging surface of an inkjet head to be more adequately cleaned than the known art.

Solutions to Problems

This invention provides a head cleaning apparatus for cleaning an inkjet head having an ink discharging surface from which an ink is discharged. The cleaning apparatus includes: a cleaning liquid reserving tank to contain a cleaning liquid for the ink discharging surface; a removing unit that removes dirt and/or ink stain from the ink discharging surface while the ink discharging surface is being immersed in the cleaning liquid in the cleaning liquid reserving tank; and a wiping member that wipes off the cleaning liquid remaining on the ink discharging surface after the removal of dirt and/or ink stain by the removing unit. The removing unit and the wiping member are both disposed in the cleaning liquid reserving tank.

In the head cleaning apparatus thus characterized, while the ink discharging surface of the inkjet head is being immersed in the cleaning liquid in the cleaning liquid reserving tank, dirt and/or ink stain adhered to the ink discharging surface is removed by the removing unit. Thus, dirt and/or ink stain may be removed from the ink discharging surface into the cleaning liquid abundantly contained in the cleaning liquid reserving tank. This may prevent that dirt and/or ink stain removed from the ink discharging surface is entrapped in the ink discharge ports of the ink discharging surface.

In the head cleaning apparatus disclosed herein, the wiping member wipes off the cleaning liquid remaining on the ink discharging surface after the removal of dirt and/or ink stain by the removing unit. This may expedite drying of the ink discharging surface, leading to an improved workability in cleaning the ink discharging surface.

Accordingly, the head cleaning apparatus disclosed herein may allow the ink discharging surface of the inkjet head to be more adequately cleaned in less time than the known art.

In the head cleaning apparatus disclosed herein, the removing unit may include a contact removing member that makes contact with the ink discharging surface while the ink discharging surface is being immersed in the cleaning liquid in the cleaning liquid reserving tank to remove dirt and/or ink stain from the ink discharging surface.

In the head cleaning apparatus thus characterized, dirt and/or ink stain adhered to the ink discharging surface of the inkjet head may be removed by the contact removing member, and dirt and/or ink stain transferred from the ink discharging surface to the contact removing member may be removed as well by the cleaning liquid in the cleaning liquid reserving tank. Thus, the contact removing member per se may be cleaned by the cleaning liquid. The ink discharging surface of the inkjet head, therefore, may be cleaned by the contact removing member freshly cleaned by the cleaning liquid.

The head cleaning apparatus thus characterized can successfully clean the ink discharging surface of the inkjet head.

In the head cleaning apparatus disclosed herein, the removing unit may further include a first driver and a second driver. The first driver drives the contact removing member in contact with the ink discharging surface to rub a plurality of times a region of the ink discharging surface in contact with the contact removing member. The second driver drives the contact removing member to move along the ink discharging surface to displace a region on the ink discharging surface in contact with the contact removing member.

The contact removing member rubs plural times the region of the ink discharging surface in contact with the contact removing member, effectively removing dirt and/or ink stain from the ink discharging surface.

The region in contact with the contact removing member is displaced along the ink discharging surface, so that the ink discharging surface may be entirely rubbed by the contact removing member.

The head cleaning apparatus thus characterized can effectively clean the whole ink discharging surface of the inkjet head.

The head cleaning apparatus disclosed herein may further include a liquid level adjusting mechanism that adjusts a liquid level of the cleaning liquid in the cleaning liquid reserving tank. The liquid level adjusting mechanism may adjust a liquid level in a vertical direction of the cleaning liquid in the cleaning liquid reserving tank to an equal level to or above the ink discharging surface at the time of removing off dirt and/or ink stain on the ink discharging surface using the removing unit. The liquid level adjusting mechanism may adjust the liquid level in the vertical direction of the cleaning liquid in the cleaning liquid reserving tank to stay below the ink discharging surface at the time of wiping off the cleaning liquid remaining on the ink discharging surface using the wiping member after the removal of dirt and/or ink stain by the contact removing member. The wiping member may have a contact portion that makes contact with the ink discharging surface at the time of wiping off the cleaning liquid remaining on the ink discharging surface after the removal of dirt and/or ink stain by the removing unit. The contact portion may be immersed in the cleaning liquid in the cleaning liquid reserving tank when the liquid level of the cleaning liquid adjusted has a level required for the removing unit to remove dirt and/or ink stain from the ink discharging surface.

In the head cleaning apparatus thus characterized, dirt and/or ink stain adhered to the ink discharging surface of the inkjet head can be removed by the contact removing member driven by the removing unit. At the same time, dirt and/or ink stain adhered to the contact portion of the wiping member can also be removed by the cleaning liquid in the cleaning liquid reserving tank. Therefore, after the removal of dirt and/or ink stain by the removing unit, the cleaning liquid remaining on the ink discharging surface can be wiped off, and the ink discharging surface can be wiped by the wiping member freshly cleaned by the cleaning liquid. The head cleaning apparatus thus characterized can successfully clean the ink discharging surface of the inkjet head.

An inkjet printer disclosed herein includes: an inkjet head having an ink discharging surface from which an ink is discharged; a cleaning liquid reserving tank to contain a cleaning liquid for the ink discharging surface; a removing unit that removes dirt and/or ink stain on the ink discharging surface while the ink discharging surface is being immersed in the cleaning liquid in the cleaning liquid reserving tank; and a wiping member that wipes off the cleaning liquid remaining on the ink discharging surface after the removal of dirt and/or ink stain by the removing unit.

In the inkjet printer thus characterized, while the ink discharging surface of the inkjet head is being immersed in the cleaning liquid in the cleaning liquid reserving tank, dirt and/or ink stain adhered to the ink discharging surface is removed in the cleaning liquid by the removing unit. Thus, dirt and/or ink stain may be removed from the ink discharging surface into the cleaning liquid abundantly contained in the cleaning liquid reserving tank.

This may prevent that dirt and/or ink stain removed from the ink discharging surface is entrapped in the ink discharge ports on the ink discharging surface.

In the inkjet printer disclosed herein, the wiping member wipes off the cleaning liquid remaining on the ink discharging surface after the removal of dirt and/or ink stain by the removing unit. This may expedite drying of the ink discharging surface, leading to an improved workability in cleaning the ink discharging surface. The inkjet printer thus characterized may allow the ink discharging surface of the inkjet head to be more adequately cleaned than the known art.

In the inkjet printer disclosed herein, the removing unit may include a partial removing member that removes dirt and/or ink stain in part from the ink discharging surface. The inkjet printer further may further include an independent-driver that moves the partial removing member and the wiping member independently from each other along the ink discharging surface.

After the removal of dirt and/or ink stain by the partial removing member of the removing unit, the cleaning liquid may be left on the ink discharging surface. The inkjet printer thus characterized, aside from wiping off the remaining cleaning liquid using the wiping member, may successfully remove dirt and/or ink stain from the ink discharging surface by using the wiping member alone, without having to use the partial removing member for removal of dirt and/or ink stain.

The inkjet printer disclosed herein may further include a container that contains ink to be supplied to the inkjet head, and a backflow valve disposed in an ink flow channel between the container and the inkjet head. The backflow valve can suppress the risk of backflow of the ink from the inkjet head toward the container.

While the ink discharging surface is being immersed in the cleaning liquid to be cleaned by the removing unit, the cleaning liquid contaminated with dirt and/or ink stain removed from the ink discharging surface by the removing unit is possibly suctioned through the ink discharge ports on the ink discharging surface and drawn into the ink flow channel. In the inkjet printer thus characterized, however, the backflow valve can suppress the risk of backflow of the dirt-contaminated cleaning liquid.

The inkjet printer disclosed herein may further include a pressure regulator disposed in the ink flow channel between the container and the inkjet head. The pressure regulator regulates the pressure of the ink supplied to the inkjet head to a negative pressure. The backflow valve may be disposed in an ink flow channel between the pressure regulator and the inkjet head.

While the ink discharging surface is being immersed in the cleaning liquid to be cleaned by the removing unit, the cleaning liquid contaminated with dirt and/or ink stain removed from the ink discharging surface by the removing unit is possibly suctioned through the ink discharge ports on the ink discharging surface and drawn into the ink flow channel. In this inkjet printer, however, the backflow valve is interposed between the inkjet head and the pressure regulator generating a suction force by which the cleaning liquid is suctioned through the ink discharge ports on the ink discharging surface. The backflow valve thus separating the pressure regulator from the inkjet head may effectively suppress the risk of backflow of the dirt-contaminated cleaning liquid.

In the inkjet printer disclosed herein, the ink may be any one of emulsion inks and ultraviolet curing inks. The inkjet head may be an inkjet head that discharges any one of emulsion inks and ultraviolet curing inks from the ink discharging surface.

Since the emulsion inks and ultraviolet curing inks excel in weather resistance once they are cured, they are difficult to be removed by cleaning. If the ink discharging surface of the inkjet head is not thoroughly cleaned, any one of these inks left and cured on the ink discharging surface may fail to be removed by cleaning from the ink discharging surface. Cleaning of the ink discharging surface of the inkjet head is importantly carried out in a timely and thorough manner. The inkjet printer disclosed herein may allow the ink discharging surface of the inkjet head to be more adequately cleaned than the known art. The technical features of this inkjet printer, therefore, are particularly useful in any inkjet printer having an inkjet head that discharges from its ink discharging surface any one of emulsion inks and ultraviolet curing inks.

A head cleaning method disclosed herein includes: an immersing step of immersing an ink discharging surface of an inkjet head from which an ink is discharged in a cleaning liquid for the ink discharging surface in a cleaning liquid reserving tank; a removing step of removing dirt and/or ink stain from the ink discharging surface while the ink discharging surface is being immersed in the cleaning liquid in the immersing step; and a wiping step of wiping off the cleaning liquid remaining on the ink discharging surface after the removal of dirt and/or ink stain in the removing step.

In the head cleaning method thus characterized, while the ink discharging surface of the inkjet head is being immersed in the cleaning liquid in the cleaning liquid reserving tank, dirt and/or ink stain is removed in the removing step from the ink discharging surface. Thus, dirt and/or ink stain can be removed from the ink discharging surface into the cleaning liquid abundantly contained in the cleaning liquid reserving tank. This can prevent that dirt and/or ink stain removed from the ink discharging surface is entrapped in the ink discharge ports on the ink discharging surface. In the head cleaning method disclosed herein, the cleaning liquid remaining on the ink discharging surface after the removal of dirt and/or ink stain in the removing step is wiped off in the wiping step. This may expedite drying of the ink discharging surface, leading to an improved workability in cleaning the ink discharging surface. The head cleaning method thus characterized may allow the ink discharging surface of the inkjet head to be more adequately cleaned than the known art.

Advantageous Effect of the Invention

The head cleaning apparatus, the inkjet printer, and the head cleaning method disclosed herein may allow an ink discharging surface of an inkjet head to be more adequately cleaned in less time than the known art.

EMBODIMENTS OF THE INVENTION

An embodiment of this invention is hereinafter described in detail referring to the accompanying drawings.

The description starts with structural features of an inkjet printer according to this embodiment.

Figure 1:
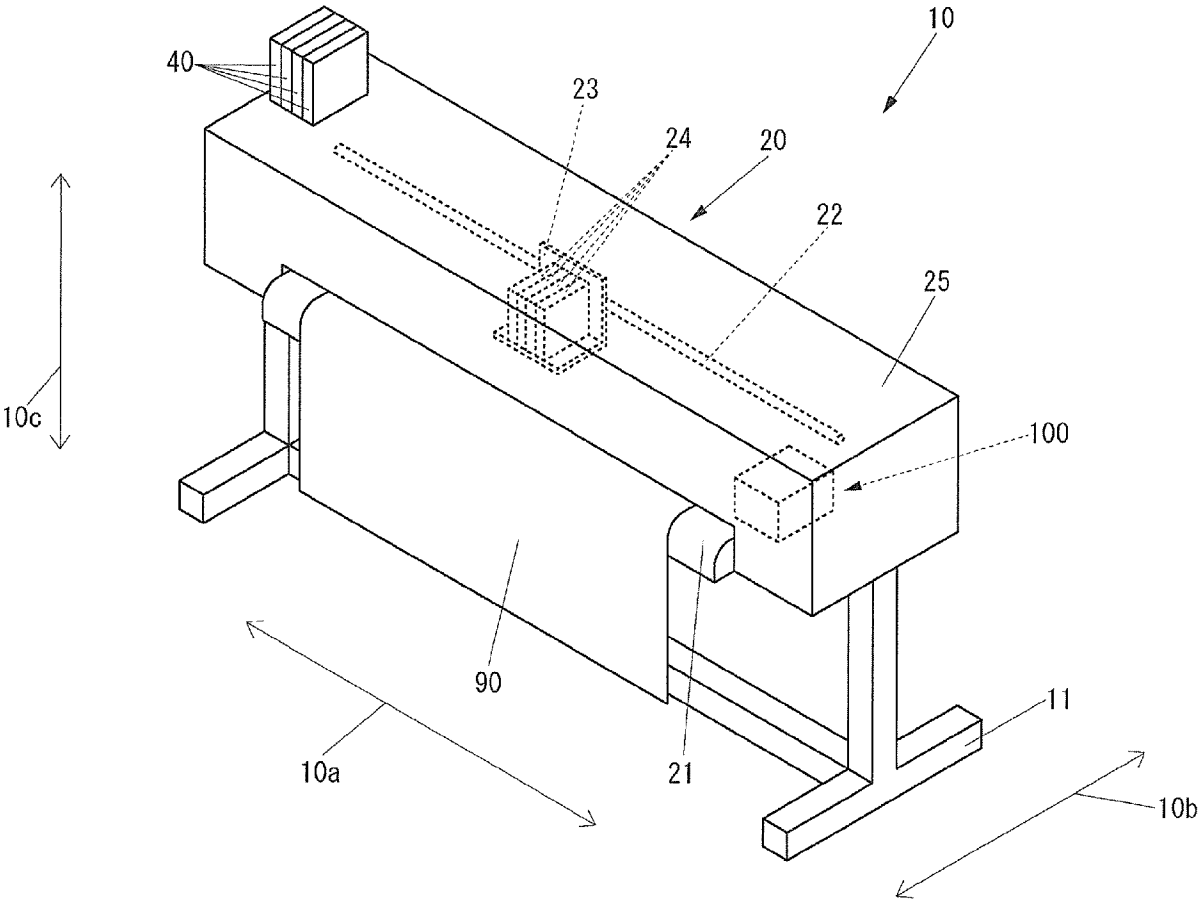
FIG. 1 is a perspective view of an external appearance of an inkjet printer according to an embodiment of this invention.

FIG. 1 is a perspective view of an external appearance of an inkjet printer 10 according to this embodiment.

As illustrated in FIG. 1, the inkjet printer 10 has legs 11 to be placed on a floor, a body 20 supported by the legs 11 and extending in a main scanning direction illustrated with an arrow 10*a*, and a plurality of ink tanks 40 from which inks are supplied to the body 20.

The body 20 has a medium transport unit 21, a guide rail 22 extending in the main scanning direction 10*a*, a carriage 23, a plurality of inkjet heads 24 for discharging the inks on a printing medium 90, a head cleaning apparatus 100, and a case 25. The medium transport unit 21 transports the printing medium 90 in a sub scanning direction illustrated with an arrow 10*b* orthogonal to the main scan direction 10*a*. The carriage 23 is supported movably in the main scanning direction by the guide rail 22. The inkjet heads 24 are mounted in the carriage 23. The head cleaning apparatus 100 is for use in cleaning the ink discharging surface of the inkjet heads 24. The guide rail 22, carriage 23, inkjet heads 24, and head cleaning apparatus 100 are covered with the case 25.

The ink tanks 40 are disposed in an upper section of the body 20 in a vertical direction illustrated with an arrow 10*c* orthogonal to both the main scanning direction 10*a* and the sub scanning direction 10*b*. The ink tanks 40 are containers containing the inks to be supplied to the inkjet heads 24.

Figure 2:
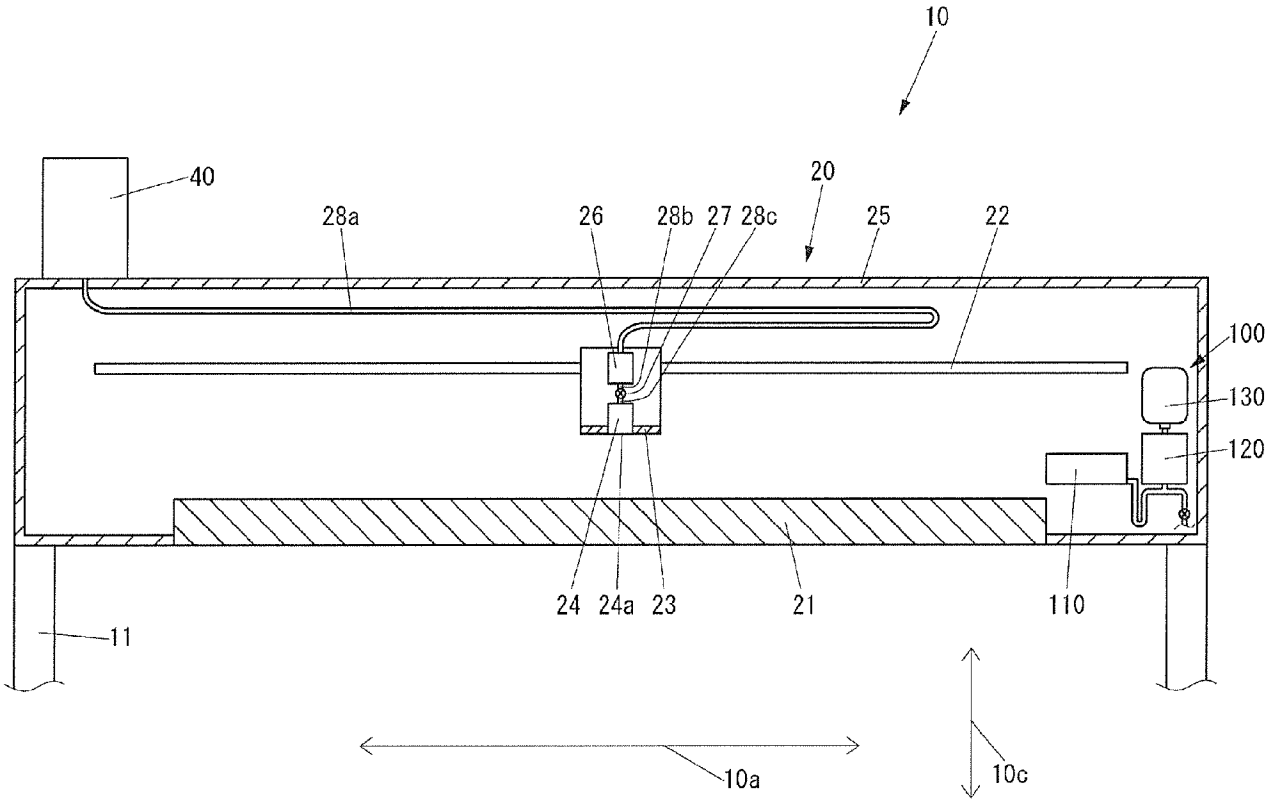
FIG. 2 is a schematic drawing of an ink supply system in the inkjet printer illustrated in FIG. 1.

FIG. 2 is a schematic drawing of an ink supply system of the inkjet printer 10.

To assist understanding of this invention, FIG. 2 only illustrates one of ink flow channels between the ink tanks 40 and the inkjet heads 24. In fact, there are ink flow channels, between the ink tanks 40 and the inkjet heads 24, as many as all of combinations of the ink tanks 40 and the inkjet heads 24 supplied with the inks from the ink tanks 40.

As illustrated in FIG. 2, the inkjet head 24 has an ink discharging surface 24*a* from which the ink is discharged. The ink discharging surface 24*a* has multiple ink discharge ports, not illustrated in the drawing. The ink is discharged through these discharge ports.

As illustrated in FIG. 2, the body 20 has a pressure regulator 26, an electromagnetic valve 27 (backflow valve), a tube 28*a* (flexible tube), a tube 28*b*, and a tube 28*c*. The pressure regulator 26 regulates the pressure of the ink to be supplied to the inkjet head 24 to a certain range of negative pressure. The electromagnetic valve 27 is disposed in an ink flow channel between the pressure regulator 26 and the inkjet head 24, and serves to block backflow of the ink from the inkjet head 24 to the ink tank 40. The tube 28*a* forms an ink flow channel between the ink tank 40 and the pressure regulator 26. The tube 28*b* forms an ink flow channel between the pressure regulator 26 and the electromagnetic valve 27. The tube 28*c* fonts an ink flow channel between the electromagnetic valve 27 and the inkjet head 24.

The pressure regulator 26 and the electromagnetic valve 27 are mounted in the carriage 23.

The pressure regulator 26, electromagnetic valve 27, and tubes 28*a* to 28*c* constitute the ink flow channel between the ink tank 40 and the inkjet head 24.

The head cleaning apparatus 100 is disposed at an end position in a moving range of the inkjet head 24 in the main scanning direction 10*a*.

Figure 3:
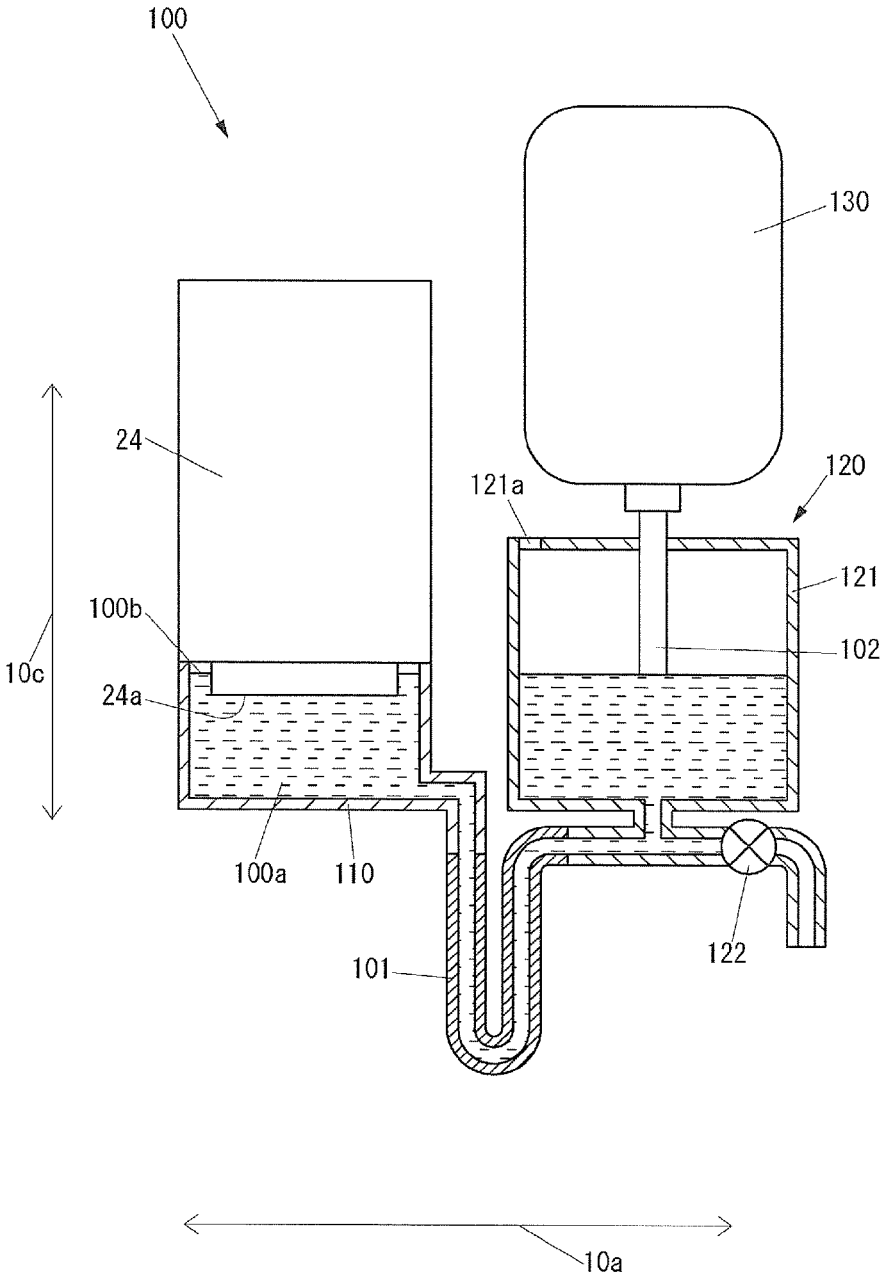
FIG. 3 is a longitudinal view in cross section of a head cleaning apparatus, illustrated in FIG. 2, when a cleaning liquid reserving tank is currently containing a cleaning liquid.

FIG. 3 is a longitudinal view in cross section of the head cleaning apparatus 100 when a cleaning liquid reserving tank 110 is currently containing a cleaning liquid 100*a*.

As illustrated in FIG. 3, the head cleaning apparatus 100 has the cleaning liquid reserving tank 110 containing the cleaning liquid 100*a* for the ink discharging surface 24*a*, a liquid level adjusting mechanism 120 that adjusts the level of a liquid surface 100*b* of the cleaning liquid 100*a* contained in the cleaning liquid reserving tank 110, and a cleaning liquid storage tank 130 from which the cleaning liquid 100*a* is supplied.

The liquid level adjusting mechanism 120 has a reserving tank 121 for containing the cleaning liquid 100*a* supplied from the cleaning liquid storage tank 130. A tube 101 connecting the reserving tank 121 to the cleaning liquid reserving tank 110 is connected to a lower section of the reserving tank 121. A valve 122 is disposed at an intermediate position in the tube 101. The valve 122 opens when the cleaning liquid 100*a* is drained out of the cleaning liquid reserving tank 110. The valve 122 is located at a position on the lower side of the reserving tank 121 in the vertical direction 10*c*.

The reserving tank 121 has a through hole 121*a* formed in an upper section thereof in the vertical direction 10*c*. The through hole 121*a* serves to regulate the amount of air in the reserving tank 121.

The head cleaning apparatus 100 has a flexible tube 101 and a tube 102. The tube 101 communicates the cleaning liquid reserving tank 110 and the reserving tank 121 with each other. The tube 102 communicates the reserving tank 121 and the cleaning liquid storage tank 130 with each other.

The cleaning liquid storage tank 130 is fixed to the reserving tank 121 with the tube 102 interposed therebetween.

Figure 4A:
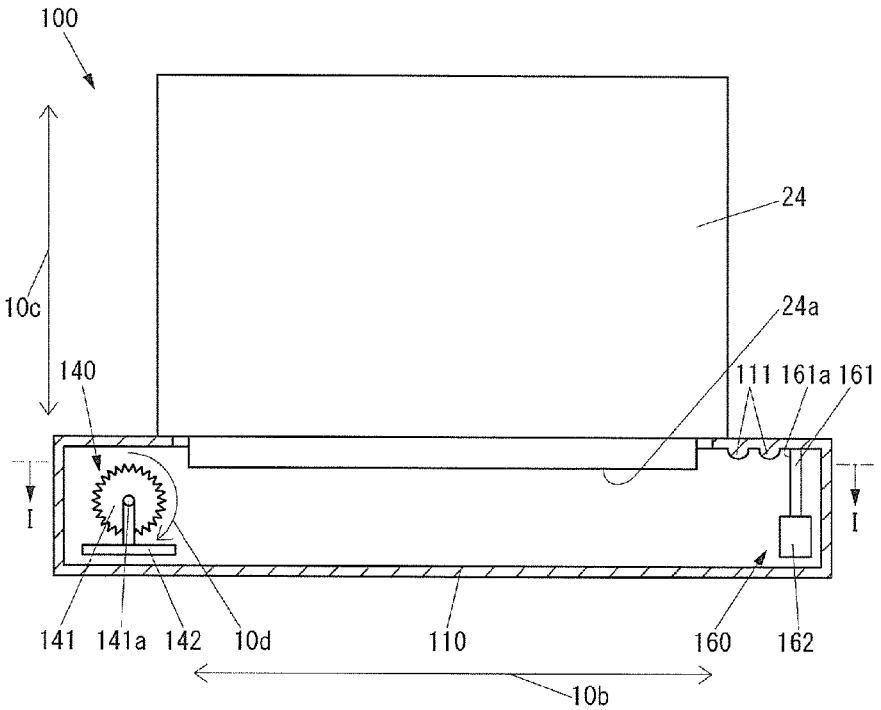
FIGS. 4A and 4B are drawings illustrated to describe the cleaning liquid reserving tank.
Figure 4B:
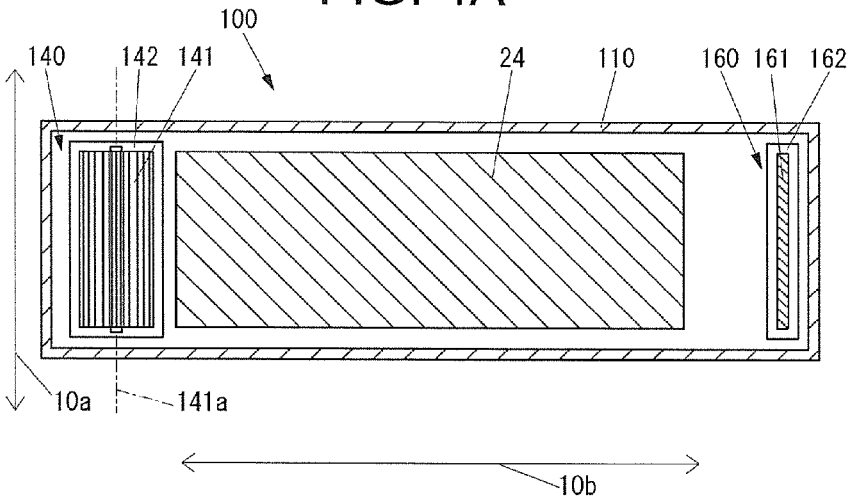

FIG. 4A is a lateral view in cross section of the cleaning liquid reserving tank 110 currently not containing the cleaning liquid 100*a*. FIG. 4B is a view of FIG. 4A in cross section along I-I.

As illustrated in FIGS. 4A and 4B, the head cleaning apparatus 100 has a removing unit 140 that removes dirt and/or ink stain from the ink discharging surface 24*a*, and a wiping unit 160 that wipes off the cleaning liquid 100*a* remaining on the ink discharging surface 24*a* (see FIG. 3) after the removal of dirt and/or ink stain by the removing unit 140.

The removing unit 140 is disposed inside of the cleaning liquid reserving tank 110. The removing unit 140 has a contact removing member, while staying in contact with the ink discharging surface 24*a*, rubs the ink discharging surface 24*a* to remove dirt and/or ink stain from the ink discharging surface 24*a*. The contact removing member employed in this embodiment is a brush 141 in the form of a roller.

The removing unit 140 has the brush 141 and a table 142 rotatably supporting the brush 141. The brush 141 is rotatable on the table 142 around an axis of rotation 141*a*along the main scanning direction (arrow 10*a* in the drawing).

The brush 141 and the table 142 are disposed inside of the cleaning liquid reserving tank 110.

The table 142 is disposed inside of the cleaning liquid reserving tank 110 movably in the sub scanning direction 10*b*. The table 142 can retreat to an end position in the sub scanning direction 10*b* as illustrated in FIGS. 4A and 4B.

The wiping unit 160 is disposed in the cleaning liquid reserving tank 110 together with the removing unit 140. The wiping unit 160 has a wiping member that wipes off the cleaning liquid 100*a* remaining on the ink discharging surface 24*a* after the removal of dirt and/or ink stain by the brush 141 of the removing unit 140. The wiping member employed in this embodiment is a rubber-made wiper 161.

The wiping unit 160 has this wiper 161 and a table 162 that supports the wiper 161. The wiper 161 and the table 162 are disposed inside of the cleaning liquid reserving tank 110.

The wiper 161 has a contact portion 161*a* in an upper section thereof in the vertical direction 10*c*. The contact portion 161*a* contacts the ink discharging surface 24*a* at the time of wiping off the cleaning liquid remaining on the ink discharging surface 24*a* after the removal of dirt and/or ink stain by the brush 141 of the removing unit 140.

The table 162 is disposed in the cleaning liquid reserving tank 110 movably in the sub scanning direction 10*b*. The table 162 can retreat to an end position in the sub scanning direction 10*b* as illustrated in FIGS. 4A and 4B.

The cleaning liquid reserving tank 110 has wiper cleaning protrusions 111 in an upper section thereof in the vertical direction. The wiper cleaning protrusions 111 contact the contact portion 161*a* of the wiper 161 to clean the wiper 161.

Figure 5:
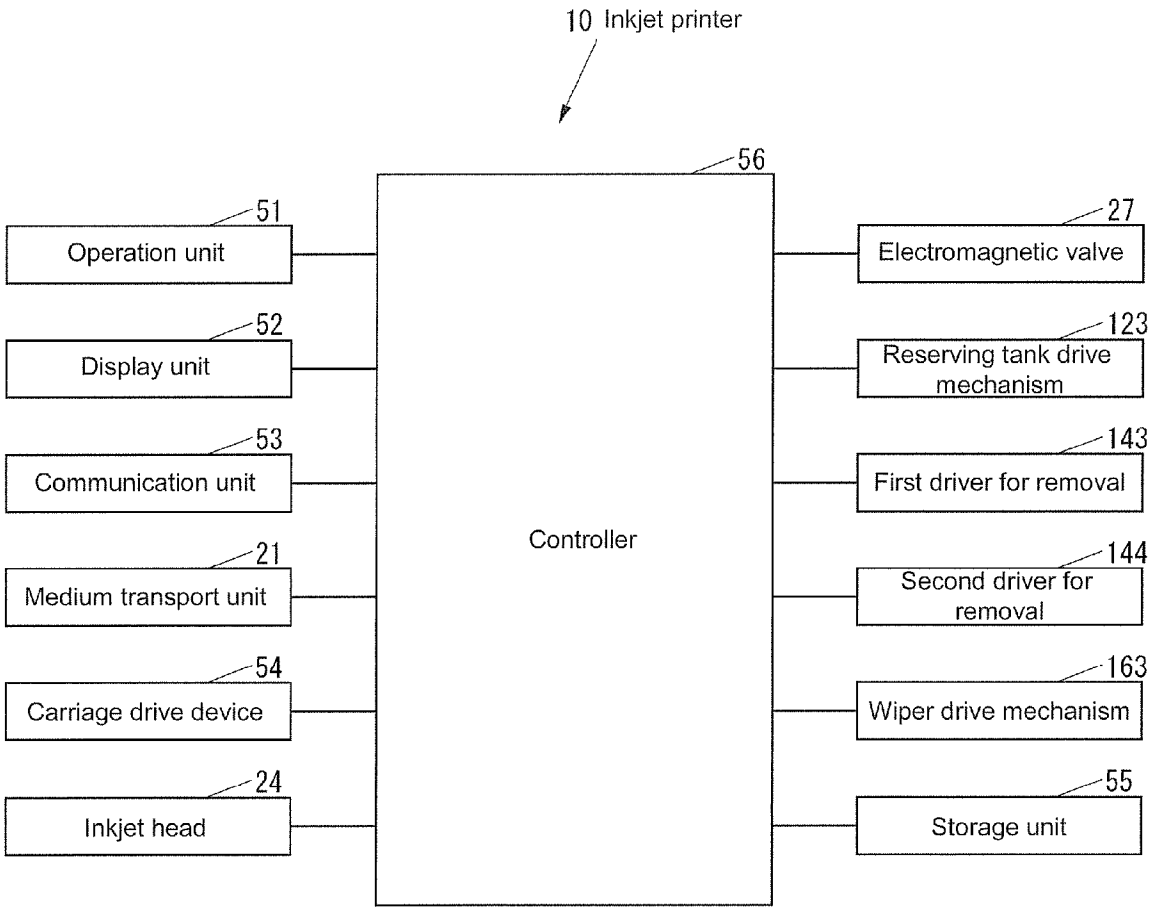
FIG. 5 is a block diagram of the inkjet printer illustrated in FIG. 1.

FIG. 5 is a block diagram of the inkjet printer 10.

As illustrated in FIG. 5, an operation unit 51 of the inkjet printer 10 is an input device through which various instructions are input to the inkjet printer 10. Examples of the operation unit 51 may include buttons to be pushed by a user.

A display unit 52 displays thereon various pieces of information. An example of the display unit 52 is a liquid crystal display (LCD) device.

A communication unit 53 is a communication device that allows the display unit 52 and an external device, such as a personal computer (PC), to communicate with each other.

A carriage drive device 54 moves the carriage 23 (see FIG. 1) along the guide rail 22 (see FIG. 1) in the main scanning direction 10*a* (see FIG. 1).

A reserving tank drive mechanism 123 drives the reserving tank 121 (see FIG. 3) to move in the vertical direction 10*c* (see FIG. 3).

A first driver for removal 143 drives the brush 141 (see FIGS. 4A and 4B) to repeatedly rub the ink discharging surface 24*a* (see FIGS. 4A and 4B) in part. This drive mechanism constitutes the first driver.

A second driver for removal 144 drives the brush 141 to move along the ink discharging surface 24*a* in the sub scanning direction 10*b* (see FIGS. 4A and 4B). This drive mechanism constitutes the second driver.

A wiper drive mechanism 163 drives the wiper 161 (see FIGS. 4A and 4B) to move along the ink discharging surface 24*a* in the sub scanning direction.

A storage unit 55 stores therein various kinds of data, an example of which may be EEPROM (Electrically Erasable Programmable Read Only Memory).

A controller 56 controls the overall operation of the inkjet printer 10. The devices connected to the controller 56 may include, in addition to the before-mentioned ones, the medium transport unit 21, inkjet heads 24, and electromagnetic valve 27.

The reserving tank drive mechanism 123 moves the reserving tank 121 in the vertical direction. This drive mechanism may be constructed of components including a motor. The reserving tank drive mechanism 123 constitutes a part of the liquid level adjusting mechanism 120 (see FIG. 3).

The first driver for removal 143 rotates the brush 141 around the axis of rotation 141*a* (see FIGS. 4A and 4B) in a direction illustrated with an arrow 10*d* (see FIGS. 4A and 4B). In this embodiment, the brush 141, by moving in sliding contact with the ink discharging surface 24*a*, repeatedly rub a predetermined section on the ink discharging surface 24*a* to remove dirt and/or ink stain adhered to the ink discharging surface 24*a*.

The first driver for removal 143 may be constructed of components including a motor, and constitutes a part of the removing unit 140 (see FIGS. 4A and 4B).

The second driver for removal 144 moves the table 142 supporting the brush 141 (see FIGS. 4A and 4B) along the ink discharging surface 24*a* in the sub scanning direction (arrow 10*b* in FIGS. 4A and 4B). This movement of the table 142 in the sub scanning direction is prompted when the rotating brush 141 moves in sliding contact with the predetermined section of the ink discharging surface 24*a*.

The second driver for removal 144 may be constructed of components including a motor, and constitutes a part of the removing unit 140 (see FIGS. 4A and 4B).

Examples of the second driver for removal 144 may include a pair of magnets (not illustrated in the drawings). The magnets may be oppositely arranged. Specifically, one of the magnets is set on the table 142, and the other magnet is set on the outer side of the cleaning liquid reserving tank 110. By moving the magnet on the outer side of the cleaning liquid reserving tank 110 in the sub scanning direction, the table 142 may be moved by a magnetic attraction between the magnets.

The wiper drive mechanism 163 moves the table 162 (see FIGS. 4A and 4B) along the ink discharging surface 24*a* in the sub scanning direction 10*b* to move the wiper 161 set on the table 162 along the ink discharging surface 24*a* in the sub scanning direction.

The wiper drive mechanism 163 may be constructed of components including a motor, and constitutes a part of the wiping unit 160 (see FIGS. 4A and 4B).

Examples of the wiper drive mechanism 163 may include a pair of magnets (not illustrated in the drawings). The magnets may be oppositely arranged. Specifically, one of the magnets is set on the table 162, and the other magnet is set on the outer side of the cleaning liquid reserving tank 110. By moving the magnet on the outer side of the cleaning liquid reserving tank 110 in the sub scanning direction, the table 162 may be moved by a magnetic attraction between the magnets.

The controller 56 includes a central processing unit (CPU), a read-only memory (ROM) in which various kinds of data and programs are prestored, and a random access memory (RAM) as a working region for the CPU. The CPU runs the programs stored in the ROM or the storage unit 55.

The controller 56 prompts the carriage drive device 54 to move the carriage 23 along the guide rail 22 in the main scanning direction (see arrow 10*a* in FIG. 2), thereby moving the inkjet heads 24 mounted in the carriage 23 relative to the printing medium 90 in the main scanning direction.

During this movement of the inkjet heads 24, the controller 56 prompts the inkjet heads 24 to discharge the inks toward the printing medium 90 to carry out the printing operation in the main scanning direction.

Every time when the printing operation in the main scanning direction ends, the controller 56 prompts the medium transport unit 21 to move the printing medium 90 in the sub scanning direction (see arrow 10*b* in FIG. 1). The controller 56, by way of relative movement of the inkjet heads 24 to the printing medium 90 in the sub scanning direction, changes a position in the sub scanning direction at which the printing operation is carried out on the printing medium 90 by the inkjet heads 24. The controller 56 restarts the printing operation in the main scanning direction at a new printing position in the sub scanning direction.

The operation of the inkjet printer 10 is hereinafter described.

The controller 56 of the inkjet printer 10, upon receipt of printing data transmitted from an external device through the communication unit 53, prompts the medium transport unit 21, inkjet heads 24, and carriage drive device 54 to operate as described earlier based on the printing data. Thus, the printing operation using the inkjet heads 24 is carried out.

The controller 56 prompts the head cleaning apparatus 100 to clean the ink discharging surface 24*a* at a specific timing. Examples of the specific timing may include a point in time during a printing sequence carried out by the inkjet heads 24 and a point in time after the printing sequence by the inkjet heads 24 is completed.

A method of cleaning the ink discharging surface 24*a* using the head cleaning apparatus 100 is hereinafter described.

[Immersing Step]

First, the controller 56 carries out an immersing step of immersing the ink discharging surface 24*a* in the cleaning liquid 100*a* in the cleaning liquid reserving tank 110, as illustrated in FIG. 3.

In the immersing step, the controller 56 prompts the carriage drive device 54 to move the inkjet heads 24 to the position of the cleaning liquid reserving tank 110 in the main scanning direction 10*a*, so that the ink discharging surface 24*a* is inside of the cleaning liquid reserving tank 110.

After the arrival of the inkjet heads 24 at the position of the cleaning liquid reserving tank 110 in the main scanning direction 10*a*, the controller 56 may move the cleaning liquid reserving tank 110 upward in the vertical direction 10*c* using a drive mechanism, not illustrated in the drawing, so that the ink discharging surface 24*a* is inside of the cleaning liquid reserving tank 110.

In the immersing step, the controller 56 prompts the reserving tank drive mechanism 123 to move the reserving tank 121 to a specific upper-limit position in the vertical direction 10*c*, thereby adjusting the level of the liquid surface 100*b* of the cleaning liquid 100*a* in the cleaning liquid reserving tank 110.

In the immersing step, the controller 56 thus guides the ink discharging surface 24*a* into the cleaning liquid reserving tank 110, and adjusts the level of the liquid surface 100*b* of the cleaning liquid 100*a* in the cleaning liquid reserving tank 110. The controller 56 may carry out both of these actions at once or may carry out one of them prior to the other, in so far as the ink discharging surface 24*a* is immersed in the cleaning liquid 100*a* in the cleaning liquid reserving tank 110 when the immersing step is over. In the immersing step, the controller 56 may adjust the level of the liquid surface 100*b* of the cleaning liquid 100*a* in the cleaning liquid reserving tank 110 after the ink discharging surface 24*a* is guided into the cleaning liquid reserving tank 110. Otherwise, the ink discharging surface 24*a* thus moving into the cleaning liquid reserving tank 110 may crash against the liquid surface 100*b* of the cleaning liquid 100*a*, splashing the cleaning liquid 100*a* around. The liquid level adjustment described earlier may avoid such an awkward situation.

In the immersing step, the controller 56, before the ink discharging surface 24*a* is immersed in the cleaning liquid 100*a* in the cleaning liquid reserving tank 110, prompts the electromagnetic valve 27 to block backflow of the inks from the inkjet heads 24 toward the pressure regulator 26.

[Removing Step]

Subsequent to the immersing step, the controller 56 carries out a removing step of removing dirt and/or ink stain from the ink discharging surface 24*a* while the ink discharging surface 24*a* is being immersed in the cleaning liquid 100*a* in the immersing step.

Figure 6:
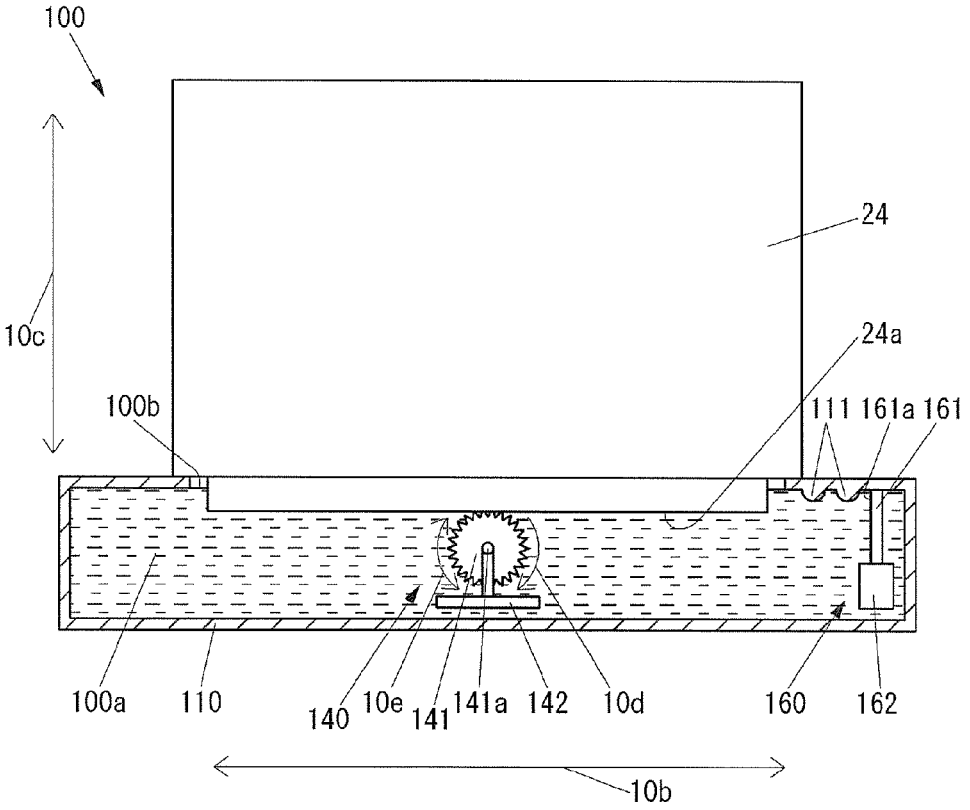
FIG. 6 is a side view in cross section of the cleaning liquid reserving tank, illustrated in FIG. 3, while dirt and/stain on the ink discharging surface of the inkjet head is being rubbed off.

FIG. 6 is a side view in cross section of the cleaning liquid reserving tank 110 while dirt and/stain is being rubbed off with the brush 141 from the ink discharging surface 24*a*.

In the removing step, the controller 56 prompts the second driver for removal 144 to move the table 142 in the sub scanning direction (see arrow 10*b* in FIG. 6), with the brush 141 being rotated around the axis of rotation 141*a* by the first driver for removal 143.

In the cleaning liquid reserving tank 110, the brush 141 is located at a position high enough to contact the ink discharging surface 24*a*.

By moving the table 142 in the sub scanning direction, the brush 141 is brought into contact with the ink discharging surface 24*a*, and a predetermined area of the ink discharging surface 24*a* in contact with the brush 141 is repeatedly rubbed by the rotating brush 141. Further, a position on the ink discharging surface 24*a* in contact with the brush 141 is displaced from one end side of the ink discharging surface 24*a* toward the other end side closer to the wiping unit 160.

By moving the table 142 from one end side of the ink discharging surface 24*a* toward the other end side, therefore, the whole ink discharging surface 24*a* is rubbed with the rotating brush 141. Then, dirt and/or ink stain adhered to the ink discharging surface 24*a* is removed by the brush 141 moving in sliding contact with the ink discharging surface 24*a*.

After the removal of dirt and/or ink stain from the ink discharging surface 24*a* by the brush 141, the controller 56 moves the table 142 from the other end side of the ink discharging surface 24*a* to a retreat position on one end side thereof (see FIGS. 4A and 4B). Then, the controller 56 ends the removing step.

After the table 142 is moved toward the retreat position, the rotating brush 141 in contact with the ink discharging surface 24*a* may be reciprocated, so that dirt and/or ink stain is removed by the rotating brush 141 from the ink discharging surface 24*a*. The table 142 may be moved toward the retreat position after the rotating brush 141 is moved downward away from the ink discharging surface 24*a*.

[Wiping Step]

Subsequent to the removing step, the controller 56 carries out a wiping step of wiping off the cleaning liquid 100*a* remaining on the ink discharging surface 24*a* from which dirt and/or ink stain has been removed in the removing step. The wiping step may preferably be carried out as soon as possible after the removing step ends.

Figure 7:
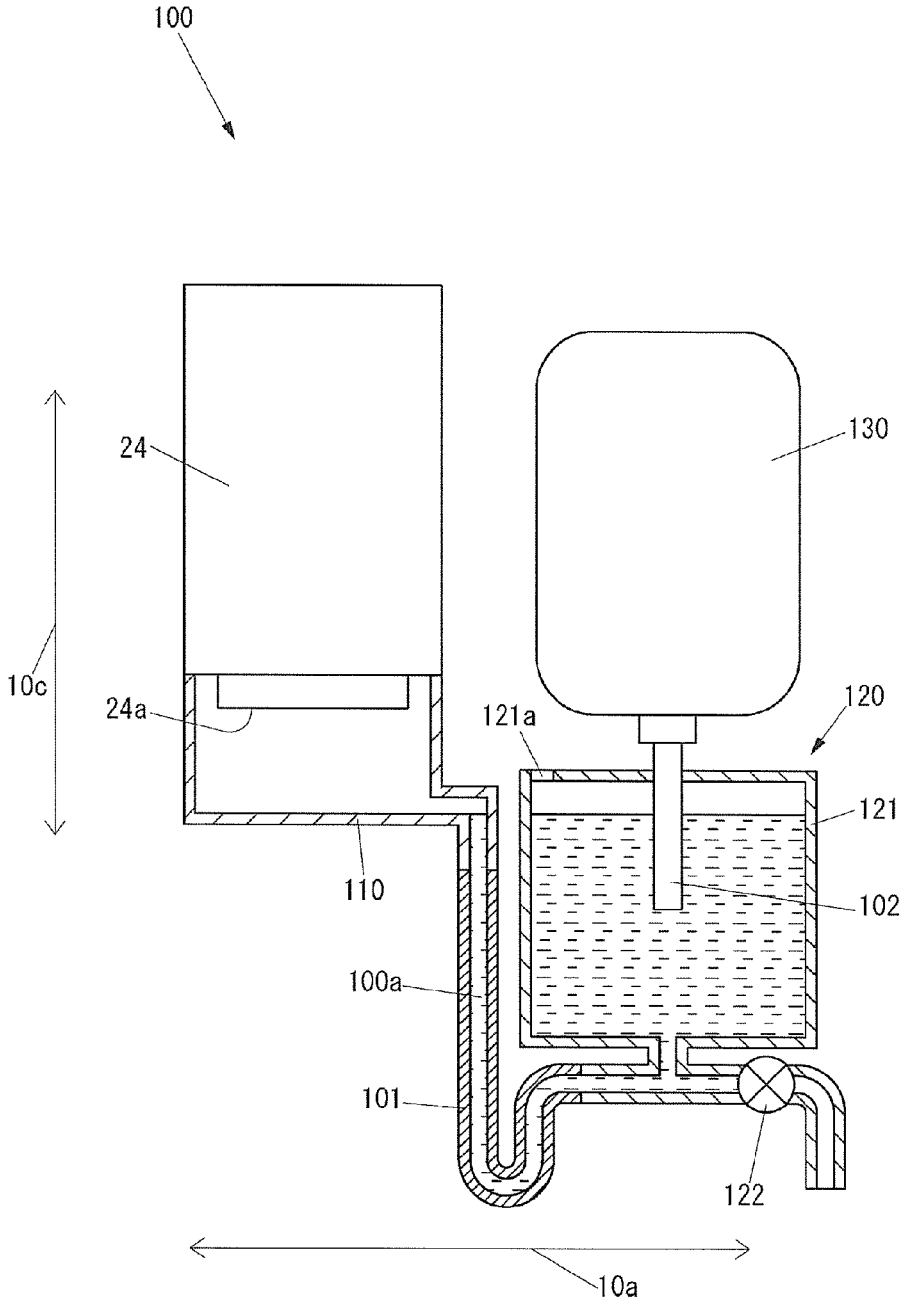
FIG. 7 is a longitudinal view in cross section of the head cleaning apparatus, illustrated in FIG. 3, when the cleaning liquid reserving tank is currently not containing the cleaning liquid.

FIG. 7 is a longitudinal view in cross section of the head cleaning apparatus 100 when the cleaning liquid reserving tank 110 is currently not containing the cleaning liquid 100*a*.

In the wiping step, the controller 56 prompts the reserving tank drive mechanism 123 (see FIG. 5) to move the reserving tank 121 to a specific lower-limit position in the vertical direction 10*c*, as illustrated in FIG. 7.

Then, the liquid surface 100*b* of the cleaning liquid 100*a* in the cleaning liquid reserving tank 110 (see FIG. 3) may be on the same level as the liquid surface in the reserving tank 121. In this embodiment, the liquid surface in the reserving tank 121 is adjusted to the same level as the bottom of the cleaning liquid reserving tank 110, so that the ink discharging surface 24*a* is not immersed in the cleaning liquid 100*a*.

Figure 8:
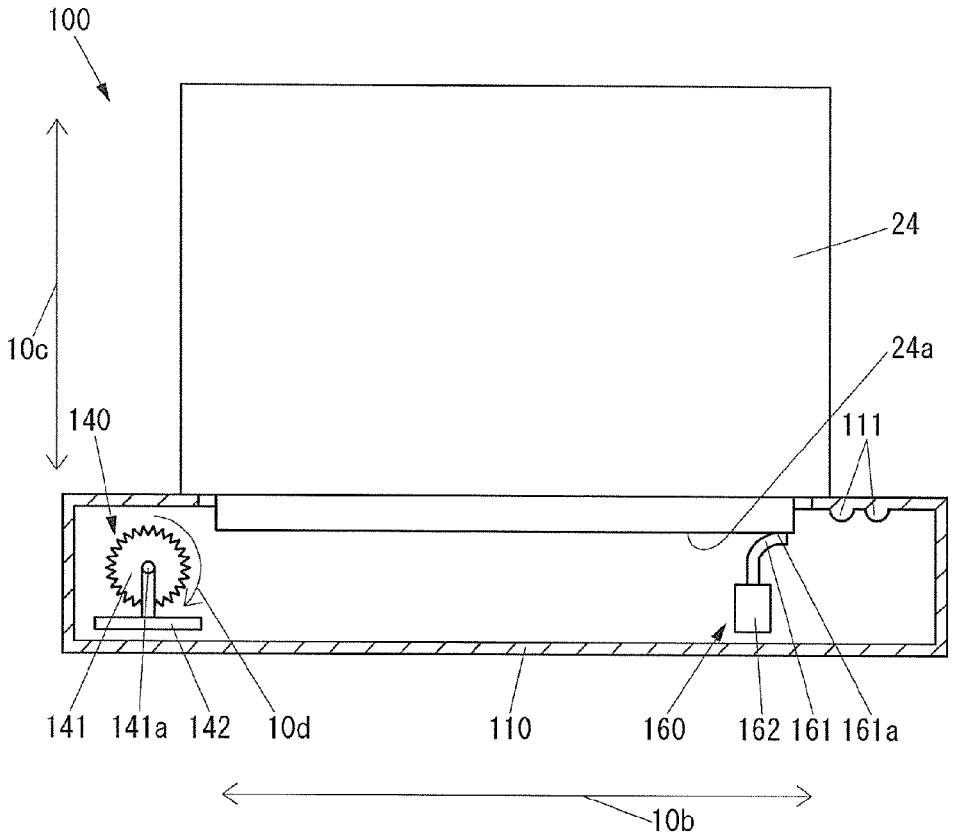
FIG. 8 is a side view in cross section of the cleaning liquid reserving tank, illustrated in FIG. 3, while the ink discharging surface of the inkjet head is being wiped by a wiper.

FIG. 8 is a side view in cross section of the cleaning liquid reserving tank 110 while the ink discharging surface 24*a* is being wiped by the wiper 161.

After the liquid level is adjusted so that the ink discharging surface 24*a* is not immersed in the cleaning liquid 100*a*, the controller 56 prompts the wiper drive mechanism 163 to move the table 162 from the other end side of the ink discharging surface 24*a* (right side on FIG. 6) toward one end side thereof (left side on FIG. 6).

The wiper 161 set on the table 162 is accordingly moved along the ink discharging surface 24*a* in the sub scanning direction (arrow 10*b* in FIG. 8).

The wiper 161 is vertically long enough to slide on the upper wall of the cleaning liquid reserving tank 110. The ink discharging surface 24*a* is located below the upper wall of the cleaning liquid reserving tank 110.

Therefore, the wiper 161 bending as illustrated in FIG. 8 moves in sliding contact with the ink discharging surface 24*a* to wipe off droplets adhered to the ink discharging surface 24*a*.

Since the wiper 161 is made of an elastic material, the wiper 161 may be bent when pressed against the ink discharging surface 24*a*. Then, dirt and/or ink stain, as well as the droplets, can be adequately wiped off by the wiper 161.

After the cleaning liquid 100*a* remaining on the ink discharging surface 24*a* is wiped off by the wiper 161, the controller 56 moves the table 162 from one end side of the ink discharging surface 24*a* to a retreat position on the other end side thereof (see FIGS. 4A and 4B). Then, the controller 56 ends the wiping step.

After the table 162 is moved toward the retreat position, the wiper 161 in contact with the ink discharging surface 24*a* may be reciprocated, so that dirt and/or ink stain is removed by the wiper 161 from the ink discharging surface 24*a*. The table 162 may be moved toward the retreat position after the wiper 161 is moved downward away from the ink discharging surface 24*a*.

In the wiping step, when the ink discharging surface 24*a* is above the liquid surface of the cleaning liquid 100*a* in the cleaning liquid reserving tank 110, the controller 56 opens the electromagnetic valve 27 (see FIG. 2), so that the electromagnetic valve 27 no longer blocks the backflow of inks from the inkjet heads 24 to the pressure regulator 26.

In the inkjet printer 10 thus characterized, while the ink discharging surface 24*a* is being immersed in the cleaning liquid 100*a* in the cleaning liquid reserving tank 110, dirt and/or ink stain is removed from the ink discharging surface 24*a* by the brush 141 of the removing unit 140. Thus, dirt and/or ink stain can be removed from the ink discharging surface 24*a* into the cleaning liquid 100*a* abundantly contained in the cleaning liquid reserving tank 110.

The inkjet printer 10, therefore, can prevent that dirt and/or ink stain removed from the ink discharging surface 24*a* is entrapped in the ink discharge ports on the ink discharging surface 24*a*.

In the inkjet printer 10, the cleaning liquid 100*a* remaining on the ink discharging surface 24*a* after the removal of dirt and/or ink stain by the removing unit 140 is wiped off by the wiper 161 disposed in the cleaning liquid reserving tank 110 together with the removing unit 140. This may expedite drying of the ink discharging surface 24*a*, leading to an improved workability in cleaning the ink discharging surface 24*a*.

The inkjet printer 10 thus characterized may allow the ink discharging surface 24*a* to be more adequately cleaned than the known art.

The inks discharged from the ink discharging surface 24*a* by the inkjet heads 24 may not be particularly limited. This invention, however, is particularly useful when the inks discharged from the ink discharging surface 24*a* by the inkjet heads 24 are difficult to be redissolved.

Examples of the inks difficult to be redissolved may include emulsion inks and ultraviolet curing inks.

Since the emulsion inks and ultraviolet curing inks excel in weather resistance once they are cured, they are difficult to be removed by cleaning. If the ink discharging surface 24*a* is not thoroughly cleaned by using a small amount of the cleaning liquid, any one of these inks left and cured on the ink discharging surface 24*a* may be very difficult to be removed by cleaning from the ink discharging surface 24*a*. Cleaning of the ink discharging surface 24*a* is importantly carried out in a timely and thorough manner The inkjet printer 10 cleans the ink discharging surface 24*a* while the ink discharging surface 24*a* is being immersed in the cleaning liquid 100*a*. This may allow the ink discharging surface 24*a* to be more adequately cleaned than the known art. The technical features of this inkjet printer, therefore, are particularly useful for the inkjet heads 24 that discharge any inks difficult to be redissolved from the ink discharging surface 24*a*, such as emulsion inks and ultraviolet curing inks.

In the inkjet printer 10, the brush 141 rotated by the first driver for removal 143 repeatedly slides on the predetermined area of the ink discharging surface 24*a*, effectively removing dirt and/or ink stain from the ink discharging surface 24*a*.

In the inkjet printer 10, the second driver for removal 144 moves the rotating brush 141 along the ink discharging surface 24*a* in the sub scanning direction, allowing the brush 141 to rub the whole ink discharging surface 24*a*. The inkjet printer 10 thus characterized may allow the whole ink discharging surface 24*a* to be effective cleaned.

In the embodiment described so far, the brush 141 is rotated around the axis of rotation 141*a* in the direction 10*d* to have the brush 141 repeatedly rub the ink discharging surface 24*a* in part. However, in the inkjet printer 10, the brush 141 may be rotated in a reciprocating motion around the axis of rotation 141*a* through a certain range of angles in a direction illustrated with an arrow 10*e* (see FIG. 6) so as to have the brush 141 repeatedly rub the ink discharging surface 24*a* in part.

In the inkjet printer 10, the first driver for removal 143 makes the brush 141 repeatedly rub the ink discharging surface 24*a* in part, while the second driver for removal 144 moves the brush 141 along the ink discharging surface 24*a*.

However, in the inkjet printer 10, any suitable contact removing member but the brush 141 may be driven by the first driver for removal 143 and the second driver for removal 144.

Figure 9A:
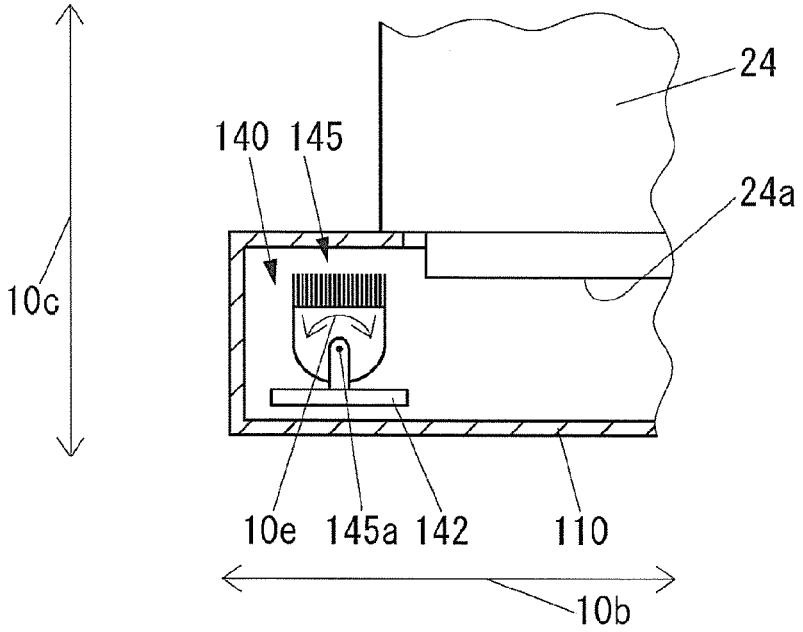
FIGS. 9A and 9B are drawings illustrating a modified example of a contact removing member.
Figure 9B:
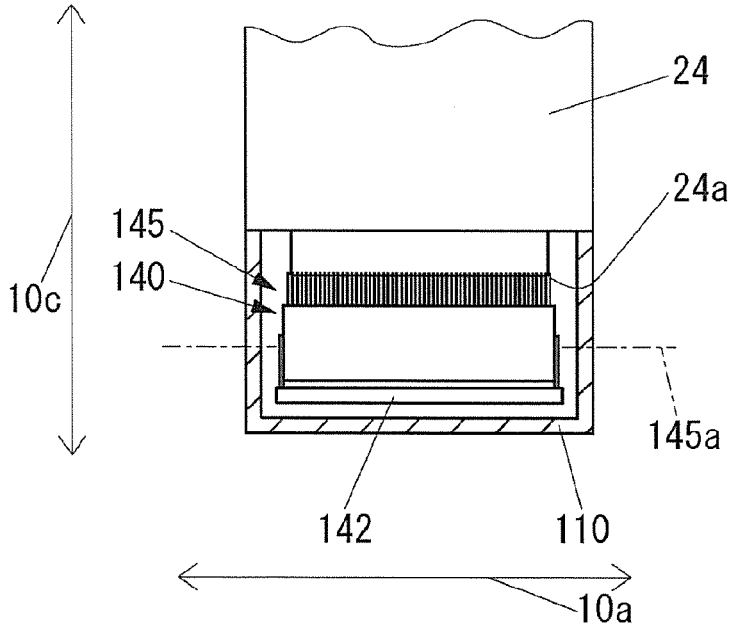

For example, the inkjet printer 10 may have, instead of the brush 141 (see FIGS. 4A and 4B), a brush 145 illustrated in FIGS. 9A and 9B on the table 142.

FIG. 9A is a side view of a contact removing member according to a modified example. FIG. 9B is a front view of the contact removing member illustrated in FIG. 9A.

The brush 145 illustrated in FIGS. 9A and 9B is a contact removing member that, while staying in contact with the ink discharging surface 24*a*, removes dirt and/or ink stain from the ink discharging surface 24*a*.

The brush 145 may be rotated in a reciprocating motion by the first driver for removal 143 (see FIG. 5) around an axis of rotation 145*a* through a certain range of angles illustrated with an arrow 10*e* so as to have the brush 145 repeatedly rub the ink discharging surface 24*a* in part.

The brush 145 may be reciprocated by the first driver for removal 143 within a certain range in the main scanning direction 10*a* or in the sub scanning direction 10*b* so as to have the brush 145 repeatedly rub the ink discharging surface 24*a* in part.

The inkjet printer 10, as described so far, has the brush 141 or the brush 145 as an example of the partial removing member that removes dirt and/or ink stain in part from the ink discharging surface 24*a*. The partial removing member of the inkjet printer 10, however, may be any other suitable member. For example, the inkjet printer 10 may have, instead of the brush 141 (see FIGS. 4A and 4B) or the brush 145 (see FIGS. 9A and 9B), a cleaning cloth 146 illustrated in FIGS. 10A and 10B on the table 142.

Figure 10A:
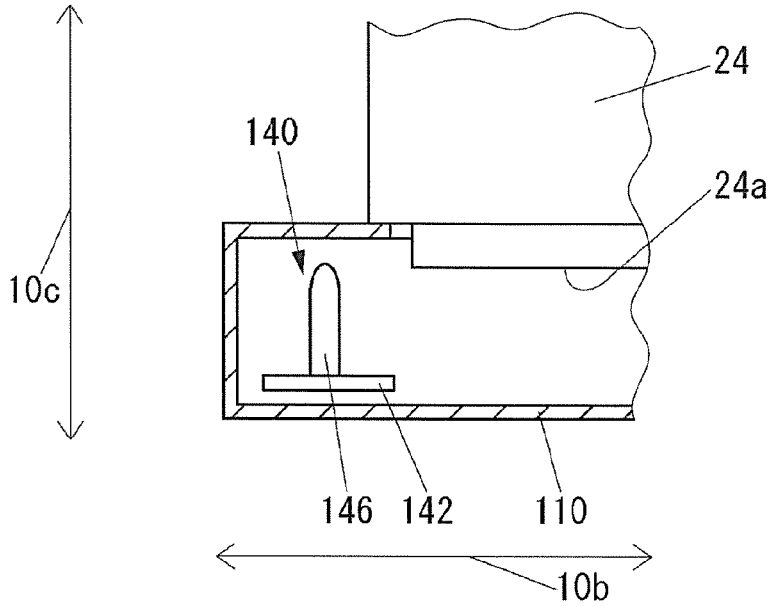
FIGS. 10A and 10B are drawings illustrating another modified example of the contact removing member.
Figure 10B:
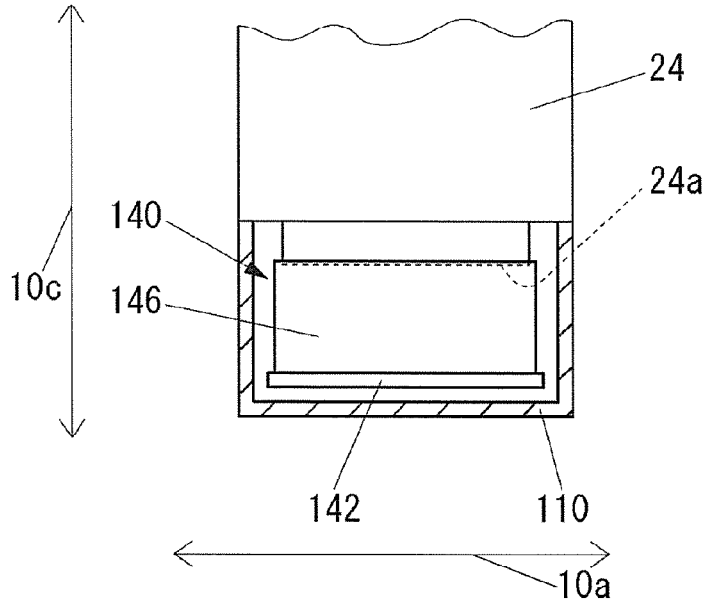

FIG. 10A is a side view of a contact removing member according to another modified example. FIG. 10B is a front view of the contact removing member illustrated in FIG. 10A.

The cleaning cloth 146 illustrated in FIGS. 10A and 10B is a contact removing member that, while staying in contact with the ink discharging surface 24*a*, removes dirt and/or ink stain from the ink discharging surface 24*a*. For example, the cleaning cloth 146 is made of felt or non-woven cloths.

The cleaning cloth 146 is moved by the second driver for removal 144 along the ink discharging surface 24*a* in the sub scanning direction 10*b* to remove dirt and/or ink stain from the ink discharging surface 24*a*.

When the inkjet printer 10 has the cleaning cloth 146 on the table 142, instead of the brush 141 (see FIGS. 4A and 4B) or the brush 145 (see FIGS. 9A and 9B), the first driver for removal 143 may be unnecessary.

The inkjet printer 10 has the brush 141 (see FIGS. 4A and 4B), brush 145 (see FIGS. 9A and 9B), or cleaning cloth 146 (see FIGS. 10A and 10B) as an example of the partial removing member that removes dirt and/or ink stain in part from the ink discharging surface 24*a*.

The inkjet printer 10 further has the second driver for removal 144 and the wiper drive mechanism 163, respectively representing the independent-driver, that allow the brush 141, brush 145, cleaning cloth 146, and wiper 161 to move along the ink discharging surface 24*a* independently from one another.

After the removal of dirt and/or ink stain by the partial removing member of the removing unit 140, the cleaning liquid 100*a* may be left on the ink discharging surface 24*a*. The inkjet printer 10 thus characterized, aside from wiping off the remaining cleaning liquid 100*a* using the wiper 161, can successfully remove dirt and/or ink stain from the ink discharging surface 24*a* by using the wiper 161 alone, without having to use the partial removing member for removal of dirt and/or ink stain from the ink discharging surface 24*a*.

Instead of the head cleaning method including the immersing step, removing step, and wiping step, the inkjet printer 10 may employ, to clean the ink discharging surface 24*a*, a head cleaning method including only two steps; immersing step and wiping step that follows the immersing step.

Figure 11:
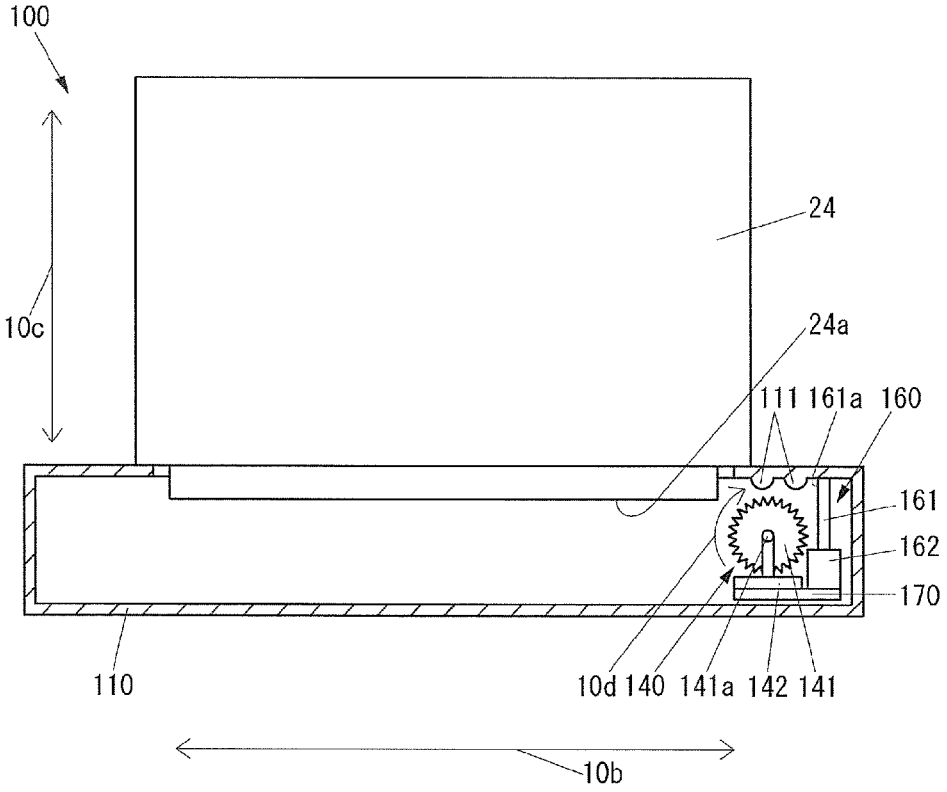
FIG. 11 is a drawing illustrating a modified example of a removing unit.

As illustrated in FIG. 11, the inkjet printer 10 may have the table 170 support the partial removing member such as the brush 141 and the wiper 161, which are all disposed in the same cleaning liquid reserving tank 110, and may use a drive mechanism to move the table 170 in the sub scanning direction 10*b*.

In the inkjet printer 10 thus configured, the partial removing member and the wiper 161 may be both moved by one drive mechanism in the sub scanning direction 10*b*.

In the inkjet printer 10, the contact removing member, such as the brush 141 (see FIGS. 4A and 4B), brush 145 (see FIGS. 9A and 9B), or cleaning cloth 146 (see FIGS. 10A and 10B) contacts the ink discharging surface 24*a* immersed in the cleaning liquid 100*a* in the cleaning liquid reserving tank 110 to remove dirt and/or ink stain adhered to the ink discharging surface 24*a*.

In the inkjet printer 10 thus characterized, dirt and/or ink stain adhered to the ink discharging surface 24*a* may be removed by the contact removing member, and dirt and/or ink stain transferred from the ink discharging surface 24*a* to the contact removing member may be removed as well by the cleaning liquid 100*a* in the cleaning liquid reserving tank 110. Thus, the contact removing member per se may be cleaned by the cleaning liquid 100*a*. The ink discharging surface 24*a*, therefore, may be cleaned by the contact removing member freshly cleaned by the cleaning liquid 100*a*. The inkjet printer 10 thus characterized may allow the ink discharging surface 24*a* to be more adequately cleaned.

When the removing unit 140 removes dirt and/or ink stain from the ink discharging surface 24*a*, the liquid level adjusting mechanism 120 adjusts the level of the liquid surface 100*b* to an equal level to or above the ink discharging surface 24*a* in the vertical direction 10*c*, as illustrated in FIG. 6.

When the wiper 161 wipes off the cleaning liquid 100*a* remaining on the ink discharging surface 24*a* after the removal of dirt and/or ink stain by the removing unit 140, the liquid level adjusting mechanism 120 adjusts the level of the liquid surface 100*b* to stay below the ink discharging surface 24*a* in the vertical direction 10*c*, as illustrated in FIG. 8.

As illustrated in FIG. 6, the contact portion 161*a* of the wiper 161 is immersed in the cleaning liquid 100*a* in the cleaning liquid reserving tank 110 when the level of the liquid surface 100*b* adjusted by the liquid level adjusting mechanism 120 is a liquid level required for the removing unit 140 to remove dirt and/or ink stain from the ink discharging surface 24*a*. In the inkjet printer 10 thus characterized, dirt and/or ink stain adhered to the ink discharging surface 24*a* can be removed by the contact removing member such as the brush 141, and dirt and/or ink stain adhered to the contact portion 161*a* of the wiper 161 can also be removed by the cleaning liquid 100*a* in the cleaning liquid reserving tank 110. Thus, the cleaning liquid 100*a*, if left on the ink discharging surface 24*a* after the removal of dirt and/or ink stain by the removing unit 140, can be wiped off by the wiper 161 freshly cleaned by the cleaning liquid 100*a*. The inkjet printer 10 thus characterized may allow the ink discharging surface 24*a* to be more adequately cleaned.

In the inkjet printer 10, the contact portion 161*a* of the wiper 161 stays in sliding contact with and moves on the lower surface of the upper wall of the cleaning liquid reserving tank 110. This upper wall has two wiper cleaning protrusions 111 protruding downward and spaced apart in the sub scanning direction (arrow 10*b* in FIG. 6).

As the wiper 161 is moved in the sub scanning direction, the contact portion 161*a* of the wiper 161 arrives at and climbs over the wiper cleaning protrusions 111. At the time, a part of the wiper 161 on the side of the contact portion 161*a* is resiliently vibrated.

Then, dirt and/or ink stain adhered to the wiper 161 may be removed by this resilient vibration from the wiper 161 into the cleaning liquid 100*a*. Thus, the wiper cleaning protrusions 111 serve to clean the contact portion 161*a* of the wiper 161.

The inkjet printer 10, by having the wiper cleaning protrusions 111 clean the contact portion 161*a*, can suitably prevent such an event that dirt and/or ink stain adhered to the contact portion 161*a* is transferred to the ink discharging surface 24*a* when the ink discharging surface 24*a* is wiped again by the wiper 161.

The inkjet printer 10 thus characterized may allow the ink discharging surface 24*a* to be more adequately cleaned.

The removing unit 140 removes dirt and/or ink stain from the ink discharging surface 24*a* using the contact removing member in contact with the ink discharging surface 24*a* immersed in the cleaning liquid 100*a* in the cleaning liquid reserving tank 110. As examples of the contact removing member, the brush 141 (see FIGS. 4A and 4B), brush 145 (see FIGS. 9A and 9B), and cleaning cloth 146 (see FIGS. 10A and 10B) have been described.

It should be understood that the removing unit 140 may be unequipped with such a contact removing member.

Figure 12A:
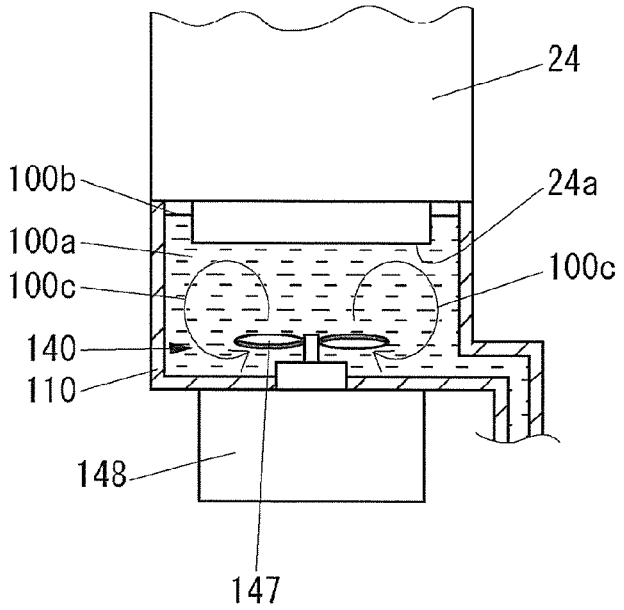
FIGS. 12A and 12B are drawings illustrating another modified example of the removing unit.
Figure 12B:
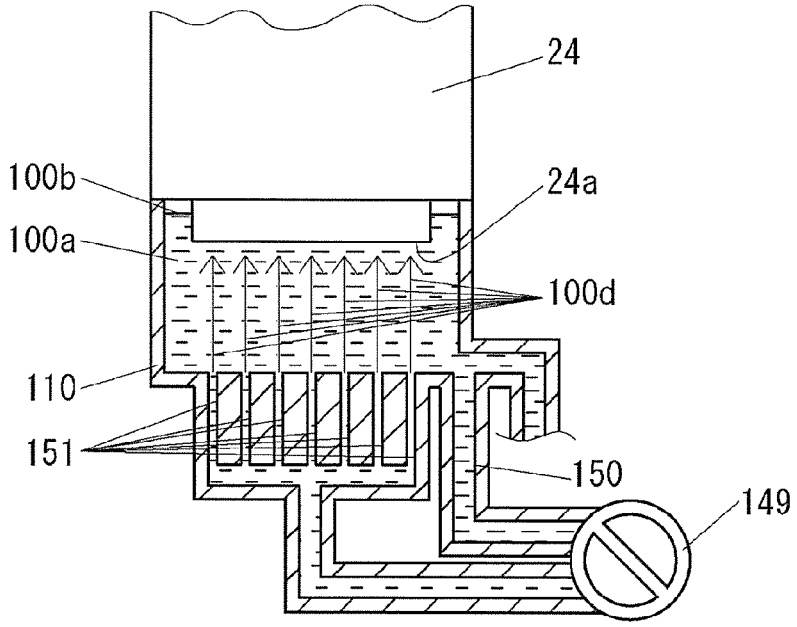

An optional example is a removing unit 140 configured to generate a flowing stream of the cleaning liquid 100*a*, as illustrated in FIGS. 12A and 12B. In that case, dirt and/or ink stain on the ink discharging surface 24*a* may be removed by the stream of the cleaning liquid 100*a*.

Figure 13:
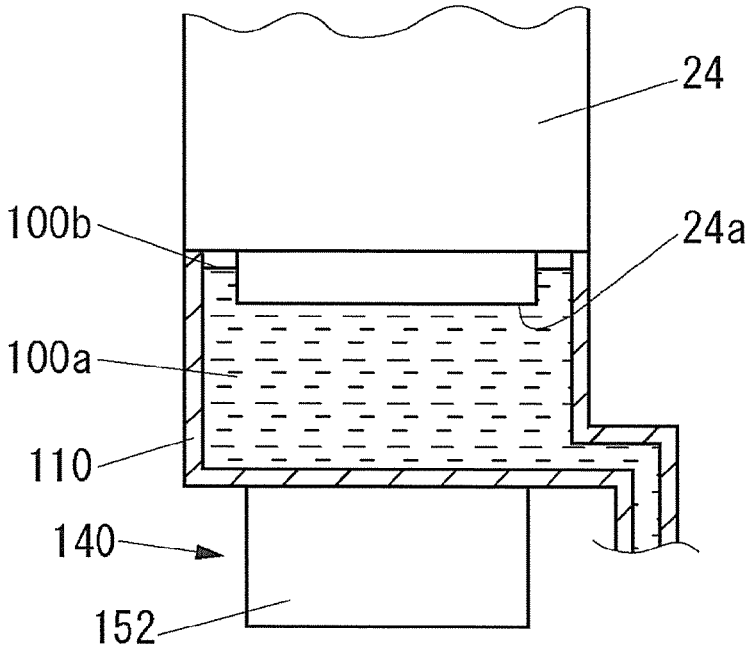
FIG. 13 is a drawing illustrating yet another modified example of the removing unit.

As illustrated in FIG. 13, dirt and/or ink stain on the ink discharging surface 24*a* may be removed by agitating the cleaning liquid 100*a*.

FIG. 12A is a front view of an example of the removing unit 140 different from those illustrated in FIGS. 4A and 4B and 9A to 11. FIG. 12B is a front view of an example of the removing unit 140 different from those illustrated in FIGS. 4A and 4B, 9A to 11, and 12A.

The removing unit 140 illustrated in FIG. 12A has a propeller 147 and a motor 148 for rotating the propeller 147. The propeller 147 generates convective flows of the cleaning liquid 100*a* in a direction illustrated with an arrow 100*c* in the cleaning liquid reserving tank 110.

In the removing step, with the ink discharging surface 24*a* being immersed in the cleaning liquid 100*a* in the cleaning liquid reserving tank 110, the controller 56 prompts the motor 148 to rotate the propeller 147 to thereby generate convective flows of the cleaning liquid 100*a* in the direction 100*c*, so that dirt and/or ink stain on the ink discharging surface 24*a* is removed by the generated convective flows.

The removing unit 140 illustrated in FIG. 12B has a circulation pump 149, and a flow channel 150 and a plurality of flow channels 151 that are both formed in the cleaning liquid reserving tank 110. The circulation pump 149 circulates the cleaning liquid 100*a* in the cleaning liquid reserving tank 110. The cleaning liquid 100*a* in the cleaning liquid reserving tank 110 is drawn through the flow channel 150 into the circulation pump 149. The cleaning liquid 100*a* is then pumped out by the circulation pump 149 into the cleaning liquid reserving tank 110 through the flow channels 151. The flow channels 151 are formed so as to face the ink discharging surface 24*a* after the ink discharging surface 24*a* is inserted in the cleaning liquid reserving tank 110. In the removing step, with the ink discharging surface 24*a* being immersed in the cleaning liquid 100*a* in the cleaning liquid reserving tank 110, the controller 56 prompts the circulation pump 149 to draw the cleaning liquid 100*a* in the cleaning liquid reserving tank 110 into the circulation pump 149 through the flow channel 150. Then, the controller 56 prompts the circulation pump 149 to pump out the cleaning liquid 100*a* into the cleaning liquid reserving tank 110 through the flow channels 151. At the time, dirt and/or ink stain on the ink discharging surface 24*a* may be removed by an arrow 100*d*-directed stream of the cleaning liquid 100*a* gushing out of the flow channels 151 into the cleaning liquid reserving tank 110.

FIG. 13 is a front view of an example of the removing unit 140 different from those illustrated in FIGS. 4A and 4B and 9A to 12B.

The removing unit 140 illustrated in FIG. 13 has an ultrasonic cleaning element 152 attached to the cleaning liquid reserving tank 110 to ultrasonically vibrate the cleaning liquid 100*a* in the cleaning liquid reserving tank 110. In the removing step, with the ink discharging surface 24*a* being immersed in the cleaning liquid 100*a* in the cleaning liquid reserving tank 110, the controller 56 prompts the ultrasonic cleaning element 152 to ultrasonically vibrate the cleaning liquid 100*a* in the cleaning liquid reserving tank 110, so that dirt and/or ink stain on the ink discharging surface 24*a* is removed by the generated vibration.

In the inkjet printer 10, the electromagnetic valve 27 is disposed in the ink flow channel between the inkjet heads 24 and the pressure regulator 26 that adjusts the pressures of the inks supplied to the inkjet heads 24 to a range of negative pressures (see FIG. 2).

While the ink discharging surface 24*a* is being immersed in the cleaning liquid to be cleaned by the removing unit 140, the cleaning liquid 100*a* contaminated with dirt and/or ink stain removed from the ink discharging surface 24*a* is possibly suctioned through the ink discharge ports on the ink discharging surface 24*a* and drawn into the ink flow channel of the inkjet printer 10. In the inkjet printer 10, however, the electromagnetic valve 27 is interposed between the inkjet heads 24 and the pressure regulator 27 generating a suction force by which the cleaning liquid 100*a* is suctioned through the ink discharge ports on the ink discharging surface 24*a*. The electromagnetic valve 27 thus separating the pressure regulator 26 from the inkjet heads 24 can effectively suppress the risk of backflow of the dirt-contaminated cleaning liquid 100*a*.

Figure 14:
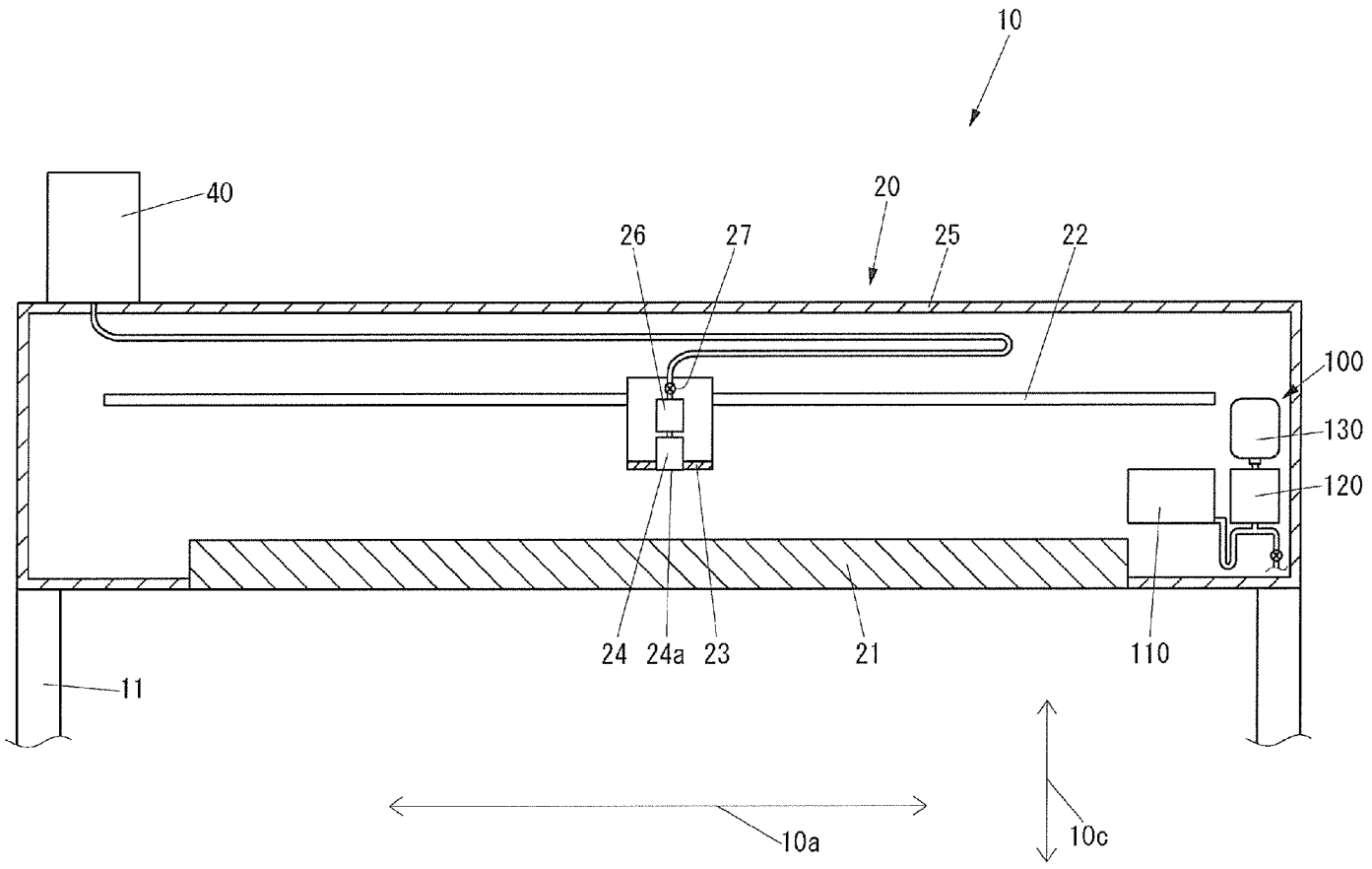
FIG. 14 is a schematic drawing of a modified example of the ink supply system in the inkjet printer.

The electromagnetic valve 27 may be located at any position in the ink flow channel between the ink tank 40 and the inkjet head 24, instead of a position in the ink flow channel between the inkjet heads 24 and the pressure regulator 26. For example, the electromagnetic valve 27 may be disposed in the ink flow channel between the ink tank 40 and the pressure regulator 26, as illustrated in FIG. 14. While the ink discharging surface 24*a* is being immersed in the cleaning liquid 100*a* to be cleaned by the removing unit 140, the cleaning liquid 100*a* contaminated with dirt and/or ink stain removed from the ink discharging surface 24*a* is possibly suctioned through the ink discharge ports on the ink discharging surface 24*a* and drawn into the ink flow channel of the inkjet printer 10. In the inkjet printer 10, however, the electromagnetic valve 27 disposed in the ink flow channel between the ink tank 40 and the inkjet head 24 can suppress the risk of backflow of the dirt-contaminated cleaning liquid.

In the embodiment described so far, the cleaning liquid storage tank 130 of the head cleaning apparatus 100 is fixed to the reserving tank 121 with the tube 102 to allow the cleaning liquid storage tank 130 and the reserving tank 121 to move together vertically upward and downward.

Figure 15:
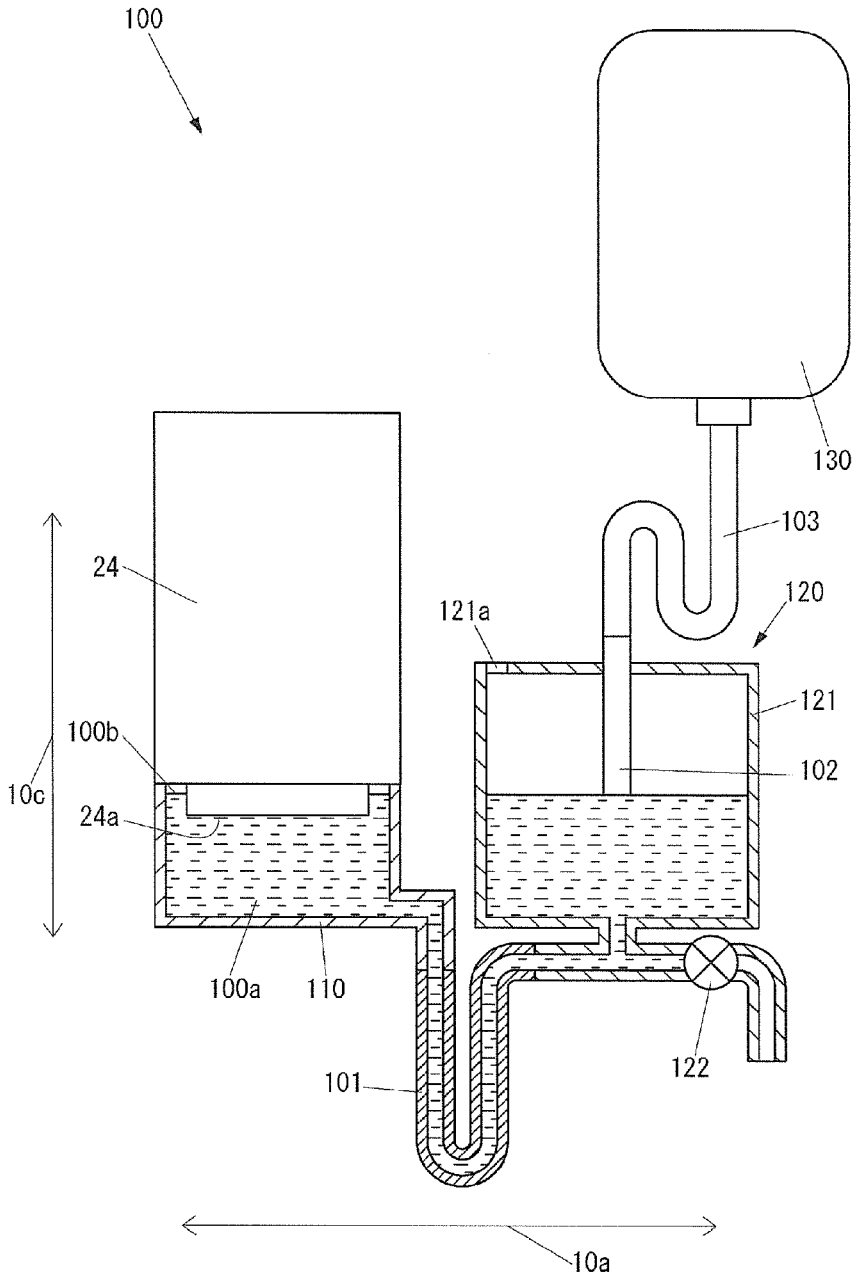
FIG. 15 is a drawing illustrating a modified example of the head cleaning apparatus.

The head cleaning apparatus 100 may be otherwise structured, for example, as illustrated in FIG. 15; the tube 102 and the cleaning liquid storage tank 130 are interconnected with the flexible tube 103 having a length large enough to allow for upward and downward relative movements of the cleaning liquid storage tank 130 and the reserving tank 121. Thus structured, the reserving tank 121 may be moved by the reserving tank drive mechanism 123 (see FIG. 5) in the vertical direction 10*c*, with the cleaning liquid storage tank 130 being constantly fixed.

The head cleaning apparatus 100 has the valve 122 for disposal of the cleaning liquid 100*a*. By opening this valve 122, the cleaning liquid 100*a* contaminated with dirt and/or ink stain removed from the ink discharging surface 24*a* may be drained out of the head cleaning apparatus 100. The valve for disposal of the cleaning liquid 100*a* may not necessarily be disposed in the reserving tank 121. The valve for disposal of the cleaning liquid 100*a* may be disposed in the cleaning liquid reserving tank 110.

In the head cleaning apparatus 100 described thus far, the wiper 161 is disposed in the cleaning liquid reserving tank 110 together with the removing unit 140. The wiper 161, however, may be disposed on the outside of the cleaning liquid reserving tank 110. When the wiper 161 is disposed on the outside of the cleaning liquid reserving tank 110, the head cleaning apparatus 100, in the wiping step, should prompt the carriage drive device 54 to move the inkjet heads 24 from the position of the cleaning liquid reserving tank 110 to the position of the wiper 161 in the main scanning direction 10*a*. This makes it unnecessary for the liquid level adjusting mechanism 120 to adjust the level of the liquid surface 100*b* of the cleaning liquid 100*a* in the cleaning liquid reserving tank 110 in order to wipe the ink discharging surface 24*a* using the wiper 161. That is to say, the head cleaning apparatus 100 needs not be equipped with the liquid level adjusting mechanism 120 when the wiper 161 is disposed on the outside of the cleaning liquid reserving tank 110.

The inkjet printer 10 according to this embodiment transports the printing medium 90 in the sub scanning direction 10*b* for relative movement of the inkjet heads 24 with respect to the printing medium 90 in the sub scanning direction. This is, however, a non-limiting example. The inkjet printer 10 may transport the inkjet heads 24 in the sub scanning direction for relative movement of the inkjet heads 24 with respect to the printing medium 90 in the sub scanning direction.

10: Inkjet printer
10*c*: Arrow (arrow illustrating vertical direction)
24: Inkjet head
24*a*: Ink discharging surface
26: Pressure regulator
27: Electromagnetic valve (backflow valve)
40: Ink tank (container)
100: Head cleaning apparatus

100*a*: Cleaning liquid
100*b*: Liquid surface
110: Cleaning liquid reserving tank
120: Liquid level adjusting mechanism
140: Removing unit
141: Brush (contact removing member, partial removing member)
143: First driver for removal (first driver)
144: Second driver for removal (second driver, independent-driver)
45: Brush (contact removing member, partial removing member)
146: Cleaning cloth (contact removing member, partial removing member)
161: Wiper (wiping member)
161*a*: Contact portion
163: Wiper drive mechanism (independent-driver)

The invention claimed is:

1. A head cleaning apparatus for cleaning an inkjet head having an ink discharging surface from which an ink is discharged, the head cleaning apparatus comprising:

a cleaning liquid reserving tank to contain a cleaning liquid for the ink discharging surface;

a removing unit that removes dirt and/or ink stain from the ink discharging surface while the ink discharging surface is being immersed in the cleaning liquid in the cleaning liquid reserving tank; and a wiping member that wipes off the cleaning liquid remaining on the ink discharging surface after the removal of dirt and/or ink stain by the removing unit, the removing unit and the wiping member both being disposed in the cleaning liquid reserving tank, the removing unit including a partial removing member that removes the dirt and/or ink stain in part from the ink discharging surface, and while a relative position of the inkjet head to the cleaning liquid reserving tank is fixed, the partial removing member being moved along the ink discharging surface in contact with the ink discharging surface while the ink discharging surface is being immersed in the cleaning liquid in the cleaning liquid reserving tank, so as to remove the dirt and/or ink stain from the ink discharging surface into the cleaning liquid.

2. The head cleaning apparatus as set forth in claim 1, wherein the removing unit further includes:

a first driver that drives the contact removing member in contact with the ink discharging surface to rub a plurality of times a region of the ink discharging surface in contact with the contact removing member; and a second driver that drives the contact removing member to move along the ink discharging surface in contact with the ink discharging surface to displace a region on the ink discharging surface in contact with the contact removing member.

3. The head cleaning apparatus as set forth in claim 2, further comprising a liquid level adjusting mechanism that adjusts a liquid level of the cleaning liquid in the cleaning liquid reserving tank, wherein the liquid level adjusting mechanism adjusts a liquid level in a vertical direction of the cleaning liquid to an equal level to or above the ink discharging surface at the time of removing off dirt and/or ink stain on the ink discharging surface using the removing unit, the liquid level adjusting mechanism adjusts the liquid level in the vertical direction of the cleaning liquid to stay below the ink discharging surface at the time of wiping off the cleaning liquid remaining on the ink discharging surface using the wiping member after the removal of dirt and/or ink stain by the removing unit, the wiping member includes a contact portion that makes contact with the ink discharging surface at the time of wiping off the cleaning liquid remaining on the ink discharging surface after the removal of dirt and/or ink stain by the removing unit, and the contact portion is immersed in the cleaning liquid in the cleaning liquid reserving tank when the liquid level of the cleaning liquid adjusted has a level required for the removing unit to remove dirt and/or ink stain from the ink discharging surface.

4. The head cleaning apparatus as set forth in claim 1, further comprising a liquid level adjusting mechanism that adjusts a liquid level of the cleaning liquid in the cleaning liquid reserving tank, wherein the liquid level adjusting mechanism adjusts a liquid level in a vertical direction of the cleaning liquid to an equal level to or above the ink discharging surface at the time of removing off dirt and/or ink stain on the ink discharging surface using the removing unit, the liquid level adjusting mechanism adjusts the liquid level in the vertical direction of the cleaning liquid to stay below the ink discharging surface at the time of wiping off the cleaning liquid remaining on the ink discharging surface using the wiping member after the removal of dirt and/or ink stain by the removing unit, the wiping member includes a contact portion that makes contact with the ink discharging surface at the time of wiping off the cleaning liquid remaining on the ink discharging surface after the removal of dirt and/or ink stain by the removing unit, and the contact portion is immersed in the cleaning liquid in the cleaning liquid reserving tank when the liquid level of the cleaning liquid adjusted has a level required for the removing unit to remove dirt and/or ink stain from the ink discharging surface.

5. The head cleaning apparatus as set forth in claim 1, further comprising a liquid level adjusting mechanism that adjusts a liquid level of the cleaning liquid in the cleaning liquid reserving tank, wherein the liquid level adjusting mechanism adjusts a liquid level in a vertical direction of the cleaning liquid to an equal level to or above the ink discharging surface at the time of removing off dirt and/or ink stain on the ink discharging surface using the removing unit, the liquid level adjusting mechanism adjusts the liquid level in the vertical direction of the cleaning liquid to stay below the ink discharging surface at the time of wiping off the cleaning liquid remaining on the ink discharging surface using the wiping member after the removal of dirt and/or ink stain by the removing unit, the wiping member includes a contact portion that makes contact with the ink discharging surface at the time of wiping off the cleaning liquid remaining on the ink discharging surface after the removal of dirt and/or ink stain by the removing unit, and the contact portion is immersed in the cleaning liquid in the cleaning liquid reserving tank when the liquid level of the cleaning liquid adjusted has a level required for the removing unit to remove dirt and/or ink stain from the ink discharging surface.

6. An inkjet printer comprising:

an inkjet head having an ink discharging surface from which an ink is discharged;

a cleaning liquid reserving tank to contain a cleaning liquid for the ink discharging surface;

a removing unit that removes dirt and/or ink stain on the ink discharging surface while the ink discharging surface is being immersed in the cleaning liquid in the cleaning liquid reserving tank; and a wiping member that wipes off the cleaning liquid remaining on the ink discharging surface after the removal of dirt and/or ink stain by the removing unit, the removing unit including a partial removing member that removes the dirt and/or ink stain in part from the ink discharging surface, and while a relative position of the inkjet head to the cleaning liquid reserving tank is fixed, the partial removing member being moved along the ink discharging surface in contact with the ink discharging surface while the ink discharging surface is being immersed in the cleaning liquid in the cleaning liquid reserving tank, so as to remove the dirt and/or ink stain from the ink discharging surface into the cleaning liquid.

7. The inkjet printer as set forth in claim 6, wherein the inkjet printer further comprises an independent-driver that moves the partial removing member and the wiping member independently from each other along the ink discharging surface.

8. The inkjet printer as set forth in claim 7, further comprising:

a container that contains the ink to be supplied to the inkjet head; and a backflow valve disposed in an ink flow channel between the container and the inkjet head, wherein the backflow valve prevents backflow of the ink from the inkjet head toward the container.

9. The inkjet printer as set forth in claim 7, wherein the inkjet head discharges from the ink discharging surface any one of emulsion inks and ultraviolet curing inks.

10. The inkjet printer as set forth in claim 6, further comprising:

a container that contains the ink to be supplied to the inkjet head; and a backflow valve disposed in an ink flow channel between the container and the inkjet head, wherein the backflow valve prevents backflow of the ink from the inkjet head toward the container.

11. The inkjet printer as set forth in claim 10, further comprising a pressure regulator disposed in the ink flow channel between the container and the inkjet head, wherein the pressure regulator regulates a pressure of the ink supplied to the inkjet head to a negative pressure, and the backflow valve is disposed in an ink flow channel between the pressure regulator and the inkjet head.

12. The inkjet printer as set forth in claim 11, wherein the inkjet head discharges from the ink discharging surface any one of emulsion inks and ultraviolet curing inks.

13. The inkjet printer as set forth in claim 10, wherein the inkjet head discharges from the ink discharging surface any one of emulsion inks and ultraviolet curing inks.

14. The inkjet printer as set forth in claim 6, wherein the inkjet head discharges from the ink discharging surface any one of emulsion inks and ultraviolet curing inks.

15. A head cleaning method, comprising:

an immersing step of immersing an ink discharging surface of an inkjet head from which an ink is discharged in a cleaning liquid for the ink discharging surface in a cleaning liquid reserving tank;

a removing step of removing dirt and/or ink stain from the ink discharging surface while the ink discharging surface is being immersed in the cleaning liquid in the immersing step, using a partial removing member that removes the dirt and/or ink stain in part from the ink discharging surface, wherein while a relative position of the inkjet head to the cleaning liquid reserving tank is fixed, the partial removing member is moved along the ink discharging surface in contact with the ink discharging surface while the ink discharging surface is being immersed in the cleaning liquid in the cleaning liquid reserving tank, so as to remove the dirt and/or ink stain from the ink discharging surface into the cleaning liquid; and a wiping step of wiping off the cleaning liquid remaining on the ink discharging surface after the removal of dirt and/or ink stain in the removing step, the removing step and the wiping step both being carried out inside of the cleaning liquid reserving tank.

* * * * *